US007011467B1

(12) United States Patent
Fiore (the younger) et al.

(10) Patent No.: US 7,011,467 B1
(45) Date of Patent: Mar. 14, 2006

(54) ORAL HYGIENE KIT WITH DISPENSING TOOTHBRUSH

(76) Inventors: Joseph Fiore (the younger), 1460 Indian Hill Rd., Bensenville, IL (US) 60106; Joseph Fiore (the elder), 1251 Edgewood St., Bensenville, IL (US) 60106

( * ) Notice: Subject to any disclaimer, the term of this patent is extended or adjusted under 35 U.S.C. 154(b) by 0 days.

(21) Appl. No.: 11/017,408

(22) Filed: Dec. 20, 2004

(51) Int. Cl.
*A46B 11/04* (2006.01)
*A46B 17/04* (2006.01)
*A46B 11/02* (2006.01)

(52) U.S. Cl. ..... 401/278; 401/188 R; 401/269

(58) Field of Classification Search ..... 401/188 R, 401/270, 272, 273, 275, 278, 279, 280, 282, 401/269; 15/106
See application file for complete search history.

(56) References Cited

U.S. PATENT DOCUMENTS

| | | | | |
|---|---|---|---|---|
| 919,440 | A | | 4/1909 | Lawson et al. |
| 1,486,394 | A | | 3/1924 | Smith |
| 1,504,143 | A | | 8/1924 | Roberts |
| 1,555,705 | A | | 9/1925 | Roberts |
| 1,563,190 | A | | 11/1925 | House |
| 1,596,365 | A | | 8/1926 | Mendoza |
| 2,018,158 | A | | 10/1935 | Violette |
| 2,259,928 | A | | 10/1941 | Eaton |
| 2,638,614 | A | | 5/1953 | Anderson |
| 2,652,949 | A | | 9/1953 | Martin |
| 2,699,889 | A | | 1/1955 | Johnson |
| 3,400,996 | A | | 9/1968 | Vandergrift |
| 3,417,762 | A | | 12/1968 | Hall |
| 3,910,706 | A | | 10/1975 | Del Bon |
| 3,937,235 | A | | 2/1976 | Broughton |
| 4,221,492 | A | | 9/1980 | Boscardin et al. |
| 4,277,194 | A | | 7/1981 | Smith |
| 5,100,252 | A | | 3/1992 | Podolsky |
| 5,158,383 | A | * | 10/1992 | Glover et al. ..... 401/150 |
| 5,407,287 | A | | 4/1995 | Braun et al. |
| 5,415,187 | A | * | 5/1995 | Heneveld ..... 132/325 |
| 6,009,886 | A | * | 1/2000 | Labranche et al. ..... 132/309 |
| 6,039,489 | A | * | 3/2000 | Harman et al. ..... 401/146 |
| 6,142,694 | A | | 11/2000 | Rivlin et al. |
| 6,179,503 | B1 | * | 1/2001 | Taghavi-Khanghah ..... 401/184 |
| 6,609,848 | B1 | * | 8/2003 | Rosenberg ..... 401/148 |

* cited by examiner

*Primary Examiner*—David J. Walczak
(74) *Attorney, Agent, or Firm*—Meroni & Meroni, P.C.; Charles F. Meroni, Jr.; Christopher J. Scott

(57) ABSTRACT

An oral hygiene kit comprises a paste-dispensing toothbrush assembly and a cooperatively associated floss assembly. The toothbrush assembly comprises a paste-dispensing brush, a paste pump assembly, a piston, and a paste reservoir. The pump assembly is operable to drive the piston within the paste reservoir for forcing paste from the paste reservoir. When forced from the paste reservoir, paste is conveyed via a paste conduit through the paste-dispensing brush to a brush head. The floss assembly is cooperatively associated with the toothbrush assembly and comprises a spool-supporting lid, a floss spool, and a floss cap. The spool-supporting lid covers the paste-dispensing brush and supports the floss spool. The floss cap covers the floss spool and provides the kit with a floss-cutting structure. Together the toothbrush assembly and the floss assembly may contribute to a user's oral hygiene.

24 Claims, 16 Drawing Sheets

ORAL HYGIENE KIT WITH DISPENSING TOOTHBRUSH

BACKGROUND OF THE INVENTION

1. Field of the Invention

The present invention generally relates to an oral hygiene kit including a combination toothbrush and toothpaste dispenser. More particularly, the present invention relates to a kit comprising a paste-dispensing toothbrush assembly and a floss-dispensing assembly. The paste-dispensing toothbrush assembly and a floss-dispensing assembly are formed into a compact, hand-holdable kit for enabling users thereof to more effectively maintain oral hygiene.

2. Description of the Prior Art

Oral hygiene art is ancient. Toothpaste has been used for about 2500 years, its origin of use being found in China and India. Modern toothpastes were developed in the 1800s. In 1824, soap was added to toothpaste as a detergent. In the 1850's, chalk was added to toothpaste. In 1873, aromatics were added to toothpaste, which were then first mass-produced in jars. In 1892, toothpaste was first sold in collapsible tubes. During the years following WWII, advancements in synthetic detergents replaced the soap used in toothpaste with emulsifying agents such as Sodium Lauryl Sulphate and Sodium Ricinoleate. Later, research resulted in the use of fluoride in toothpaste.

Toothbrush art has its origin about 5500 years ago, in the form of "chewingsticks" as used by ancient Babylonians. Ancient Greek and Roman literature further discuss primitive toothpicks used to help clean the teeth and mouth. These toothpicks matured into a chew stick, one end of which was chewed until softened and brush-like while the opposite end was pointed and used as a pick to clean food and debris from between the teeth. The sticks used were selected from aromatic trees and thus had a mouth-freshening effect.

The first true bristled toothbrush is said to have originated in China at around 1600 AD. Around 1780, the first toothbrush was made by William Addis (England). Addis, and later, his descendants, manufactured toothbrushes, the handles of which were carved out of the bone of cattle and the heads of the natural bristles were placed in the bored holes made in the bone and kept in place by thin wire. The natural bristles were obtained from the necks and shoulders of swine, especially from pigs living in colder climates like Siberia and China.

In 1857, Wadsworth was credited as the first American to receive a toothbrush patent as America entered the growing toothbrush market. In 1844, the first toothbrush was manufactured by hand and patented as a 3-row brush of serrated bristles with larger tufts by Rhein. In 1885, the Florence Manufacturing Company of Massachusetts, in association with Rhein, began producing the Pro-phy-lac-tic brush for mass marketing in the United States.

As technology progressed, synthetic bristles replaced the natural swine bristles. Nylon was first applied to the toothbrush around 1938 and by 1939, electric toothbrushes arrived in an attempt to offer the public a brush that could simulate the action of a manual brush but with better results and cleaning performance. The first real electric toothbrush was produced in 1939, developed in Switzerland. The electrical toothbrush was first marketed in the United States in 1960 by Squibb. The brush was called the Broxodent. General Electric introduced a rechargeable cordless toothbrush in 1961. Interplak was the first rotary action electrical toothbrush for home use, introduced in 1987.

Dental floss is also an ancient invention. Researchers have found dental floss and toothpick grooves in the teeth of prehistoric humans. Parmly (1790–1859) is credited as being the inventor of modern dental floss. Parmly promoted flossing with a piece of silk thread in 1815.

Current oral hygiene art has attempted to combine the above-referenced oral hygiene products into a single compact embodiment so as to more effectively enable oral hygiene for those desirous of maintaining oral hygiene. Frequently attempts to provide combined oral hygiene products have resulted in paste-dispensing toothbrush devices and systems. Some of the more pertinent patent prior art relating to paste-dispensing toothbrush devices is described briefly hereinafter.

U.S. Pat. No. 2,018,158 ('158 patent), which issued to Violette, discloses a Fountain Toothbrush. The '158 patent teaches a fountain toothbrush comprising a hollow handle portion, the interior of which is divided into communicating chambers. A dentrifice tube is removably carried in the one of the chambers and a dentrifice extrusion press, carried within the other chamber, is cooperatively engageable with the tube to force the dentrifice through the hollow handle.

U.S. Pat. No. 2,638,614 ('614 patent), which issued to Anderson, discloses a Fountain Brush Head having Sliding Valve. The '614 patent teaches a hollow head portion having apertures formed therein and to which toothpaste may be delivered. A carrier member is detachably carried by the head and bristles are mounted in the carrier. The carrier member has apertures formed therein among the bristles, which are disposed normally in alignment with the head apertures. A resiliently supported detent is formed on the carrier for securing the carrier detachably on the head. A valve member is disposed slidably between the head and the carrier, has apertures formed therein, and is adapted to be moved to and from registry with the head and carrier apertures. A handle for operating the valve is further disclosed, the handle having an interlocking sliding connection with the carrier. A resiliently supported detent is carried by the head and adapted to engage the valve handle to secure the valve in its closed position.

U.S. Pat. No. 2,652,949 ('949 patent), which issued to Martin, discloses a Dispenser with Spring Pressed Follower. The '949 patent teaches a spring closed valve carried by a handle, which handle is fixed to an elongated shank with a longitudinal passage formed in it to deliver toothpaste. The spring closed valve is attached to the handle at one end thereof and arranged to control the passage. The handle comprises two sections, the first section having a bore which opens outwardly through the end thereof, the second section having a bore which is arranged to communicate with the first bore, means for releasably fastening the sections together, the second section having a closed end wall and an aperture in a side wall thereof adjacent to the closed end wall. A spring loaded keeper is mounted pivotally within the aperture. A piston is disposed in the bores and adapted to compress a tube in the bores. A spring reacts upon and contacts one surface of the piston and the inside surface of the closed end wall of the second section. The piston has a skirt with an opining therein and the keeper is removably disposed in the opening in the piston skirt to thereby hold the piston in one position with the section and thereby hold the spring compressed between the piston and the closed end wall when placing a tube of toothpaste in the bores.

U.S. Pat. No. 2,699,889 ('889 patent), which issued to Johnson, discloses a Dispensing Toothbrush. The '889 patent teaches a tubular barrel for toothpaste and means forming an outlet at one end of the barrel. The outlet extends through the wall of the barrel, which tubular barrel has a longitudinal axis. Means forming a spider and thrust bearing are connected to the barrel and extend inwardly of the outlet. The last named means comprise ribs circumferentially spaced with respect to the longitudinal axis and have portions extending parallel to the longitudinal axis. The ribs each have a radially extending portion projecting inwardly from the axially parallel extending portions of the ribs, thus forming a recess therebetween and the radially extending portions forming a bearing within the recess. The ribs form slots therebetween communicating the outlet and the interior of the barrel. A screw shaft extends axially in the barrel and a piston is threaded on the shaft for travel along the barrel upon rotation of the shaft. A finger knob is secured to the shaft at one end of the barrel opposite the outlet and forms a closure for the end of the barrel. The shaft has an enlarged head on the end opposite the knob, which head is spaced from the outlet and is received in the recess and seated on the bearing formed by the radially extending portions.

U.S. Pat. No. 3,910,706 ('706 patent), which issued to Del Bon, discloses a Cartridge for Liquid or Pastry Dentrifice. The '706 patent teaches a cartridge adapted for use in a fountain toothbrush having a bristle carrier. A guiding sleeve member is connected to the bristle carrier for receiving the cartridge therein and serving as a handle of the toothbrush. Duct means lead from the bottom part of the sleeve member through the bristle carrier to a set of bristles on the bristle carrier. Further disclosed are actuating means in which the cartridge is adapted to be brought into engagement. The actuating means comprise a piston borne by the bristle carrier at its end away from the bristles, which cartridge is hermetically closed at the end thereof destined for facing away from the bristle carrier. The cartridge further has a reservoir for dentrifice in its interior and an outlet passage of the latter reservoir opening in that frontal face of the cartridge which is destined to face the bristle carrier. The outlet passage is adapted for receiving therein the piston in displaceable, sealing engagement.

U.S. Pat. No. 4,277,194 ('194 patent), which issued to Smith, discloses a Paste Dispensing Toothbrush. The '194 patent teaches a toothbrush having a polishing paste compartment and a plunger apparatus for forcing paste through a passageway into communication with the bristles of the toothbrush. The compartment for containing the paste may be either a re-fillable container or cartridge or a disposable cartridge. The plunger is operated by a thumb wheel drive located at the end of the toothbrush handle.

U.S. Pat. No. 5,407,287 ('287 patent), which issued to Braun et al., discloses a Toothbrush with Self-Contained Toothbrush Dispenser. The '287 patent teaches a fountain toothbrush having in its handle a toothpaste reservoir constantly pressurized by a charge of actuator gas acting through a cup-like piston disposed at the upstream end of the reservoir. The gas pressure pushes the piston and toothpaste downstream while resiliently urging the piston sidewall against the reservoir boundary wall to forwardly extrude toothpaste adjacent the boundary wall. A valve for selectively passing toothpaste from the reservoir to the brush head includes an apertured gate and a structurally separate actuator for translating the gate in a valve chamber in opposition to a bias spring. Separating the gate from the actuator permits the gate to be positively sealed against the chamber outlet by the toothpaste in the closed valve position. A lengthwise segment of the gate has a reduced thickness dimension so as not to fill the upstream side of the valve chamber, thereby avoiding the creation of a partial vacuum that would otherwise hold the gate in its open position.

U.S. Pat. No. 6,142,694 ('694 patent), which issued to Rivlin et al., discloses a Toothbrush with Reservoir for Dentrifice. The '694 patent teaches a disposable toothbrush with a built-in reservoir for dentrifice including a piston, a cord, and a rotatable spindle for forcing the dentrifice from the storage compartment through a conduit in the neck portion to the bristles in a controlled manner.

From an inspection of these patent disclosures and other art generally known in the relevant art, it will be seen that the prior art does not teach an oral hygiene kit comprising a paste-dispensing toothbrush assembly and a floss assembly, which assemblies are structurally configured to provide a user thereof with a hand-holdable kit. Thus, the prior art perceives a need for an oral hygiene kit comprising a paste-dispensing toothbrush assembly and a floss assembly, which assemblies are structurally configured to provide a user thereof with a hand-holdable kit as summarized in more detail hereinafter. It will be further seen that the prior art does not teach a paste-dispensing toothbrush assembly comprising a paste-dispensing brush, a paste pump assembly, a piston, and a paste reservoir, which pump assembly comprises a manually-operable pump member, a pump diaphragm, a plunger, a compression coil, a housing diaphragm, and a pump housing, and which pump assembly is operable to increase an initial paste pressure to a second paste pressure, the second paste pressure for forcing a portion of paste from the paste reservoir through paste conduit means (formed through the pump assembly) and the brush to a brush head thereof. Thus, the prior art perceives a need for an oral hygiene kit comprising a pump assembly as heretofore prefatorily described and which is described in more detail hereinafter.

SUMMARY OF THE INVENTION

It is thus a primary object of the present invention to provide a low cost, oral hygiene kit comprising a paste-dispensing toothbrush assembly. It is a further object of the present invention to provide a paste-dispensing toothbrush assembly cooperatively associated with a floss assembly, which floss assembly is a further element of the oral hygiene kit. In this regard, it is an object of the present invention to provide a floss assembly that functions to provide the user with both a readily available source of floss as well as a brush-covering structure. It is a further object of the present invention to provide a uniquely configured pump assembly, which pump assembly functions to compel paste initially received in a paste reservoir through a paste conduit that extends from the paste reservoir through the pump assembly and a paste-conveying brush to a brush head. Still further, it is an object of the present invention to provide an oral hygiene kit assembled in a single hand-holdable unit so as to enhance the appeal of the kit and further contribute to the user's desire to maintain oral hygiene. Further still, it is an object of the present invention to provide an oral hygiene kit or toothbrush assembly made for a single use. In this regard, it is an object of the present invention to provide a disposable oral hygiene kit or disposable paste-dispensing toothbrush assembly. Still further in this last regard, it is contemplated that the present invention may be designed for travel. In other words, it is contemplated that the present invention discloses a travel kit for enabling users thereof to more effectively maintain oral hygiene.

To achieve these and other readily apparent objectives, the present invention essentially provides an oral hygiene kit comprising a paste-dispensing toothbrush assembly and a cooperatively associated floss assembly for enabling a user to maintain the user's oral hygiene. The toothbrush assembly comprises a paste-dispensing brush, a paste pump assembly, a piston, and a paste reservoir. The paste reservoir comprises an inner reservoir surface, an outer reservoir surface, a bottom end, a housing end, a circular transverse reservoir cross-section, a reservoir height, and a central longitudinal reservoir axis. The reservoir cross-section has an inner reservoir sectional area. The product of the inner reservoir sectional area and the reservoir height together define an initial paste-receiving volume.

The piston comprises a paste-engaging surface, an atmospheric surface, and a reservoir-engaging surface. The reservoir-engaging surface extends from the paste-engaging surface to the atmospheric surface. The piston is thus piston-received in the paste reservoir. The paste pump assembly essentially comprises a brush-engaging end, a reservoir-engaging end, and paste conduit means, which conduit means extend from the reservoir-engaging end to the brush-engaging end for conveying paste from the paste reservoir to the paste-dispensing brush. The reservoir-engaging end is cooperatively associated with the housing end for creating an initial paste pressure intermediate the paste-engaging surface and the reservoir-engaging end. The piston is movable intermediate the bottom end and the housing end.

The paste-dispensing brush comprises a pump-engaging end, a brush head, an outer brush surface, a brush conduit, and a brush height. The brush conduit functions to convey paste from the brush-engaging end to the brush head. The pump-engaging end is cooperatively associated with the brush-engaging end.

Paste is receivable in the paste reservoir and thus has an initial paste volume substantially equal in magnitude to the initial paste-receiving volume. The pump assembly is operable to increase the initial paste pressure to a second paste pressure for forcing a portion of paste from the paste reservoir through the paste conduit means and the brush conduit to the brush head. The portion of paste thus decreases the second paste pressure to a pressure substantially equal to the initial paste pressure when forced from the paste reservoir. In this regard, the portion of paste has a coinciding paste portion volume. The initial paste volume is thus decremented by the paste portion volume when the pump assembly is operated. The brush head is further operable to selectively apply the portion of paste to a user's teeth and gums as a means to contribute to the user's oral hygiene. Thus, the toothbrush assembly enables a user to maintain the user's oral hygiene.

The oral hygiene kit further comprises a floss assembly cooperatively associated with the toothbrush assembly. The floss assembly comprises a spool-supporting lid, a floss spool, and a floss cap. The spool-supporting lid comprises a brush-covering inner lid surface, an outer lid surface, a seat-engaging end, a spool-supporting end, a circular transverse lid cross-section, a lid height, and a central longitudinal lid axis. The seat-engaging end is removably seatable upon the brush-engaging end. The brush height is lesser in magnitude than the lid height and the inner lid surface thus surrounds the paste-dispensing brush. The spool-supporting end comprises a spool-receiving post, which in turn comprises a post height and a central longitudinal post axis. The spool-receiving post is integrally formed with the outer lid surface. The floss spool comprises a floss length, a spool height, and an outer spool diameter. The floss length is spooled adjacent the post axis and comprises a floss length end. The post thus receives spooled floss length and the spool-supporting end supports the floss spool.

The floss cap comprises a spool-covering inner cap surface, an outer cap surface, a support-engaging end, a top end, floss provision means, a circular transverse cap cross-section, a cap height, and a central longitudinal cap axis. The reservoir axis, the lid axis, the post axis and the cap axis are collinear when the components are in an assembled state. The cap cross-section has an inner cap diameter. The support-engaging end is cooperatively associated with the spool-supporting end. The post height and the spool height are each lesser in magnitude than the cap height and the outer spool diameter is lesser in magnitude than the inner cap diameter. Thus, the inner cap surface surrounds the floss spool and the floss provision means enable a user to utilize a portion of the floss length, the portion of the floss length for further contributing to a user's oral hygiene.

Other objects of the present invention, as well as particular features, elements, and advantages thereof, will be elucidated in, or apparent from, the following description and the accompanying drawing figures.

BRIEF DESCRIPTION OF THE DRAWINGS

Other features of our invention will become more evident from a consideration of the following brief description of patent drawings, as follows:

FIG. 4(*a*) is a transverse cross sectional view of a support-engaging end of the floss cap.

FIG. 4(*b*) is a side plan view of the floss cap.

FIG. 5(*a*) is a top plan view of the floss spool shown in FIG. 5.

FIG. 6(*a*) is an enlarged transverse cross sectional view of the spool-supporting lid as sectioned intermediate a spool-supporting end and a seat-engaging end thereof.

FIG. 7(*a*) is a reduced side plan view of the paste-dispensing brush showing a brush conduit in broken lines extending from a pump-engaging end to a brush head of the brush.

FIG. 8(*a*) is an enlarged transverse cross sectional view of the pump member as sectioned through a housing-engageable outer pump surface thereof.

FIG. 10(*a*) is an enlarged transverse cross sectional view of a gateway-engaging end of the plunger.

FIG. 10(*b*) is an enlarged transverse cross sectional view of a paste-pressing end of the plunger.

FIG. 13(*a*) is an enlarged transverse cross sectional view of the pump housing as sectioned intermediate a pump-receiving end and a reservoir-engaging end of the pump housing.

FIG. 13(*b*) is an enlarged transverse cross sectional view of the reservoir-engaging end of the pump housing.

FIG. 13(*c*) is an enlarged transverse cross sectional view of a paste channel of the pump housing.

FIG. 15(*a*) is an enlarged transverse cross sectional view of the paste reservoir as sectioned intermediate a housing end and a bottom end thereof.

DETAILED DESCRIPTION OF THE PREFERRED EMBODIMENT

Figure 1:
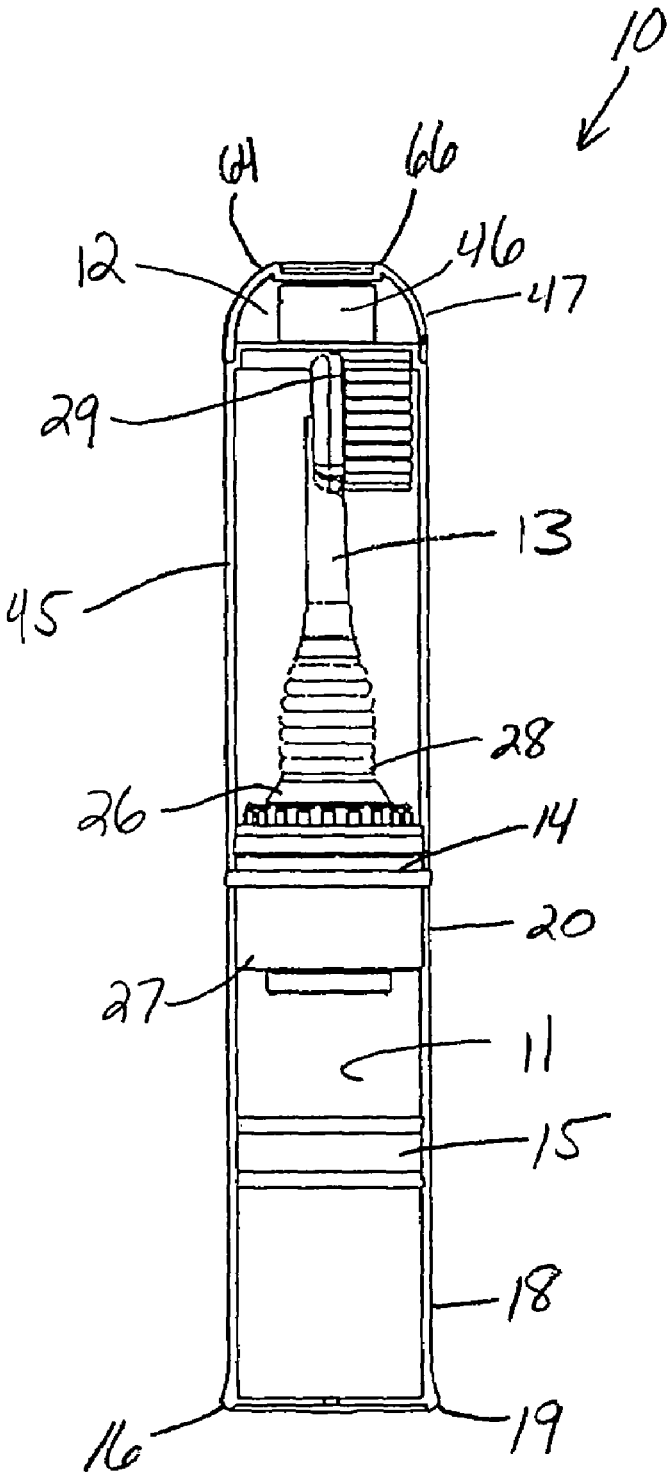
FIG. 1 is side plan view of the preferred embodiment of the oral hygiene kit in an assembled state.
Figure 2:
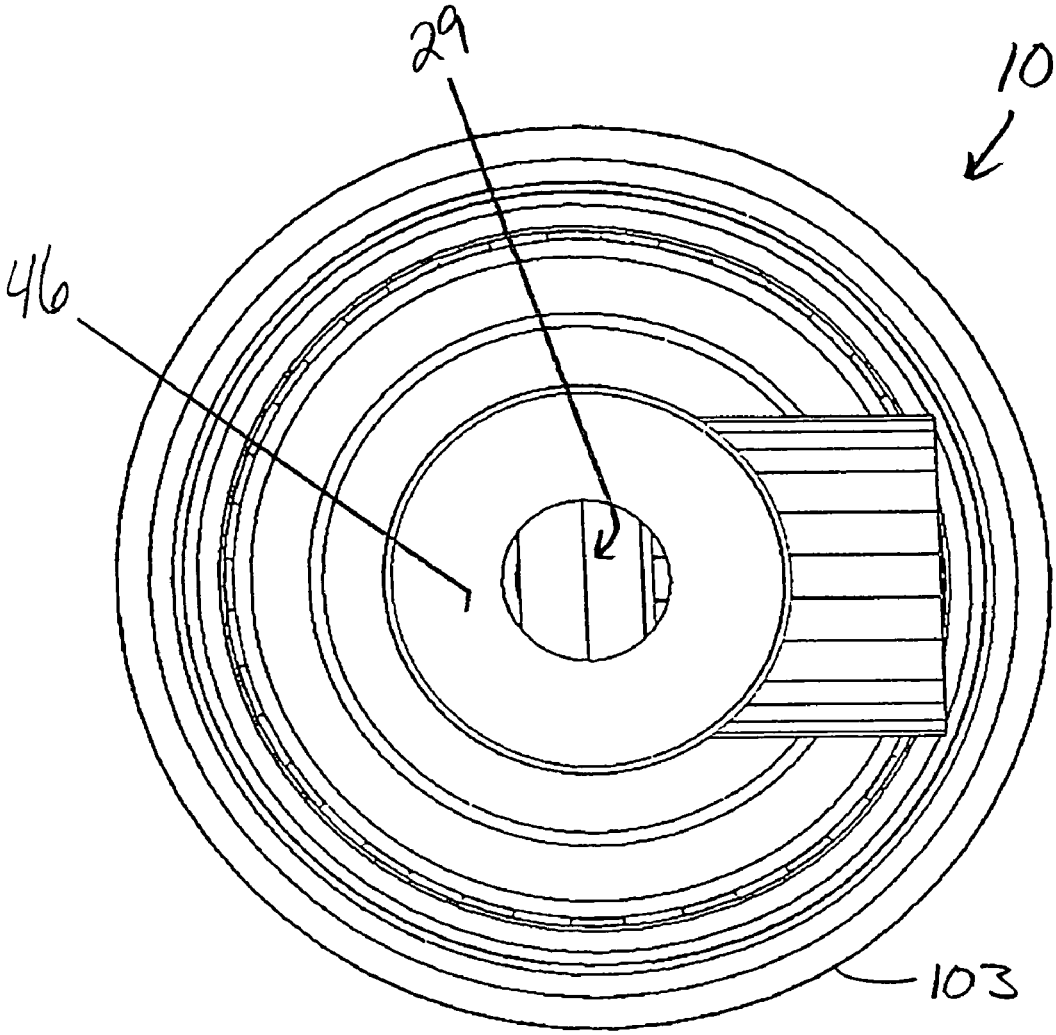
FIG. 2 is a top plan view of the oral hygiene kit as shown in FIG. 1.
Figure 3:
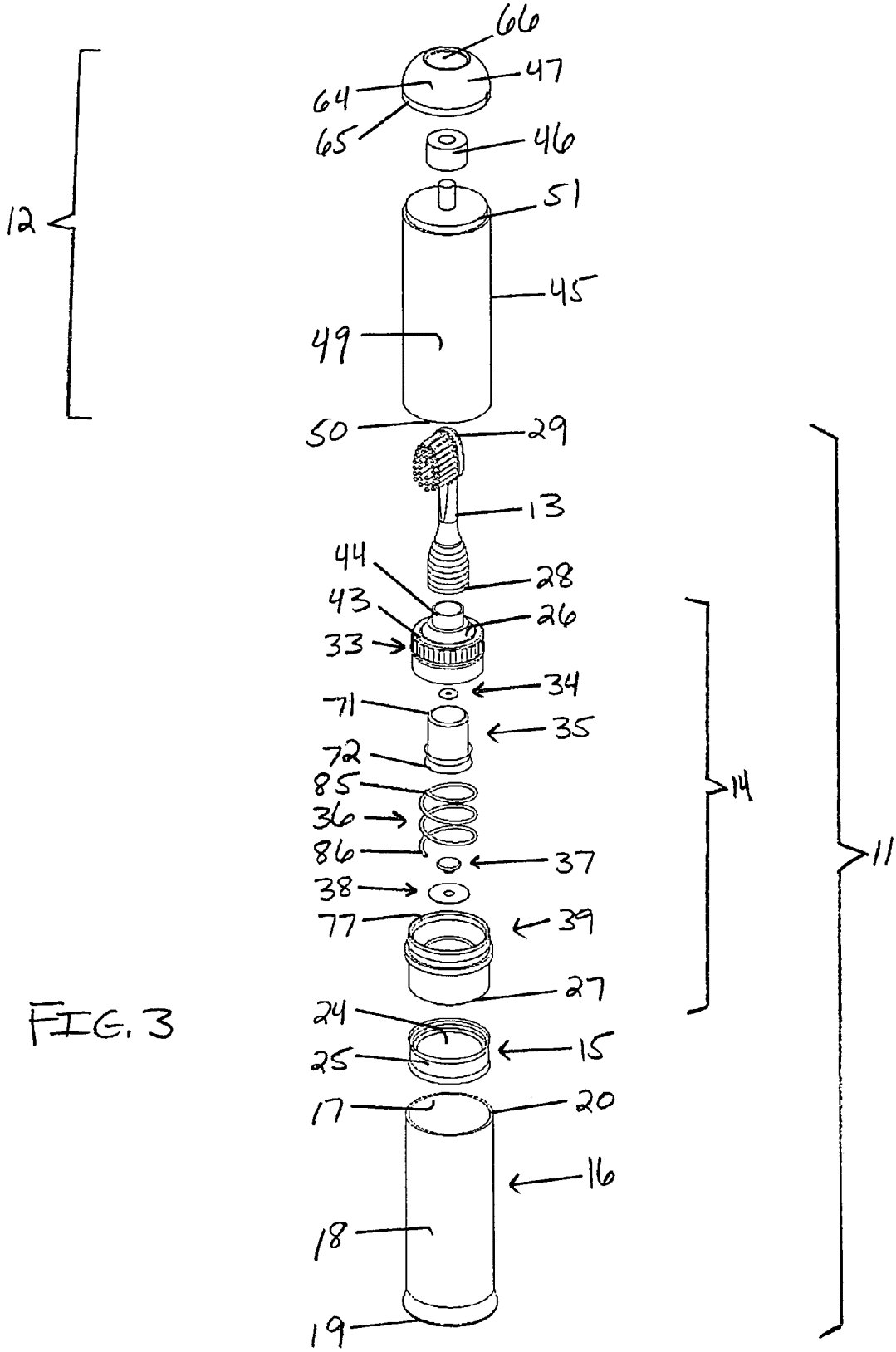
FIG. 3 is an exploded top perspective view of the oral hygiene kit showing a toothbrush assembly in inferior relation to a floss assembly.

Referring now to the drawings, the preferred embodiment of the present invention generally concerns an oral hygiene kit 10 for enabling a user to more effectively maintain his or her oral hygiene as generally illustrated and referenced in FIGS. 1–3. Oral hygiene kit 10 preferably comprises, in combination, a paste-dispensing toothbrush assembly 11 as illustrated and referenced in FIGS. 1 and 3; a floss assembly 12 as illustrated and referenced in FIGS. 1 and 3; and toothpaste or paste (not specifically illustrated). Toothbrush assembly 11 preferably comprises a paste-dispensing brush 13 as illustrated and referenced in FIGS. 1, 3, and 7; a paste pump assembly 14 as illustrated and referenced in FIGS. 1 and 3; a piston 15 as illustrated and referenced in FIGS. 1, 3, and 14; and a paste reservoir 16 as illustrated and referenced in FIGS. 1, 3, and 15. Paste reservoir 16 preferably comprises an inner reservoir surface 17 as illustrated and referenced in FIGS. 3 and 15; an outer reservoir surface 18 as illustrated and referenced in FIGS. 1, 3, and 15; a bottom end 19 as illustrated and referenced in FIGS. 1, 3, and 15; and a housing end 20 as illustrated and referenced in FIGS. 1, 3, and 15. Being preferably cylindrical in structural configuration, paste reservoir 16 further comprises a circular transverse reservoir cross-section 21 as generally referenced in FIG. 15(*a*); a reservoir height as generally referenced in FIG. 15 at 22; and a central longitudinal reservoir axis 23 as referenced in FIGS. 15 and 15(*a*). The reservoir cross-section 21 preferably comprises an inner reservoir sectional area (defined by the product of the radius [21(*a*)] squared and pi). The product of the inner reservoir sectional area and the reservoir height 22 thus defines an initial paste-receiving volume.

Figure 14:
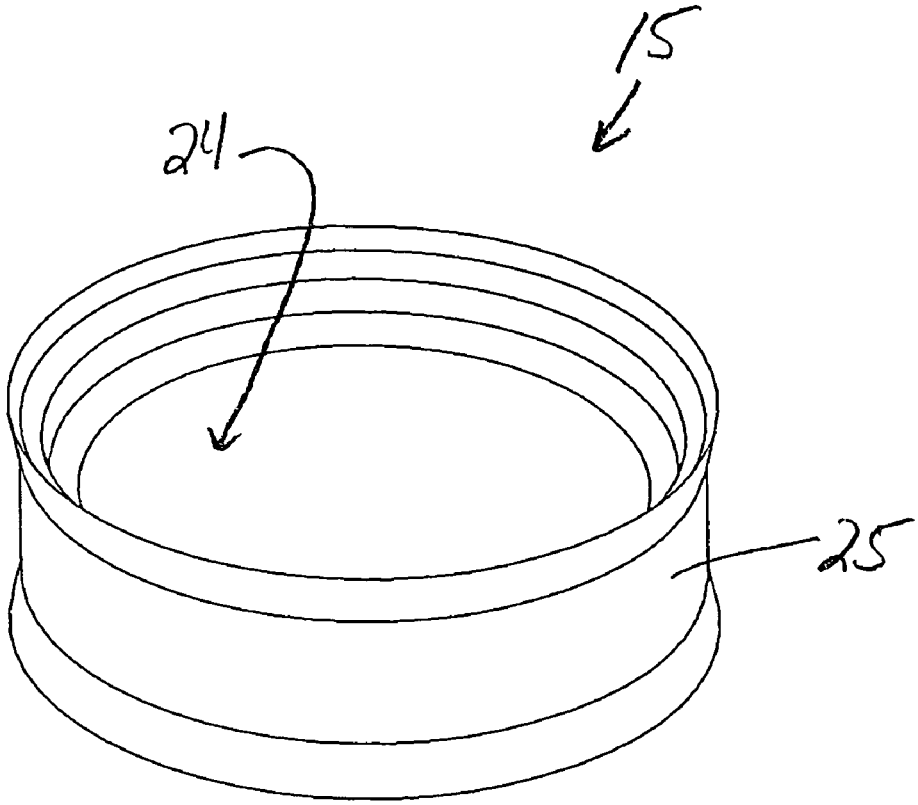
FIG. 14 is a top perspective view of a piston of the toothbrush assembly.
Figure 15:
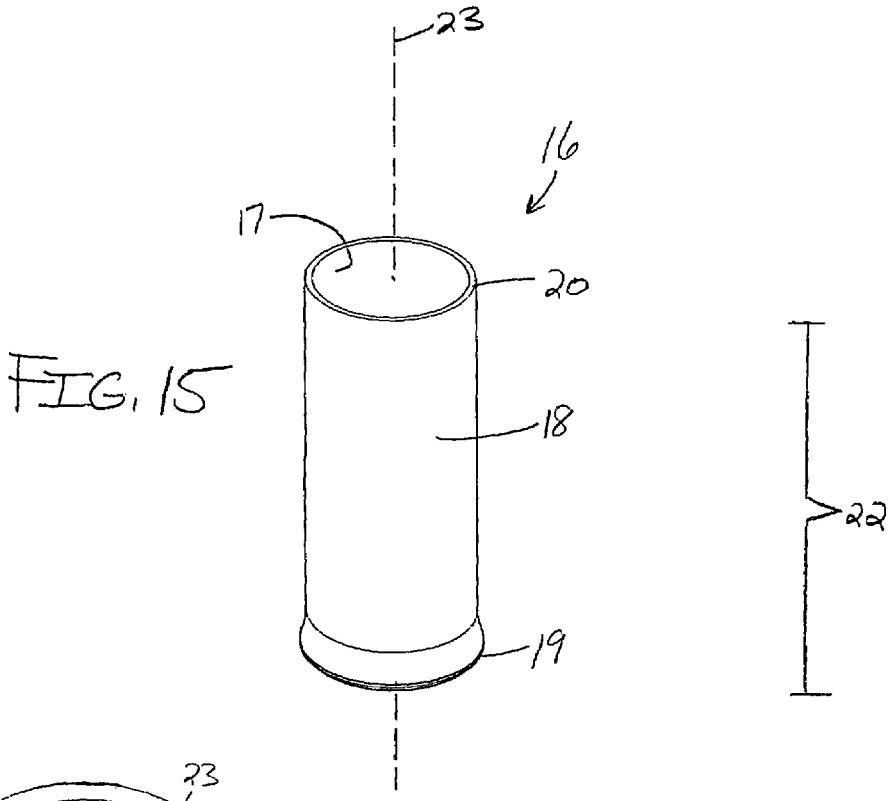
FIG. 15 is a top perspective view of a paste reservoir of the toothbrush assembly.
Figure 15A:
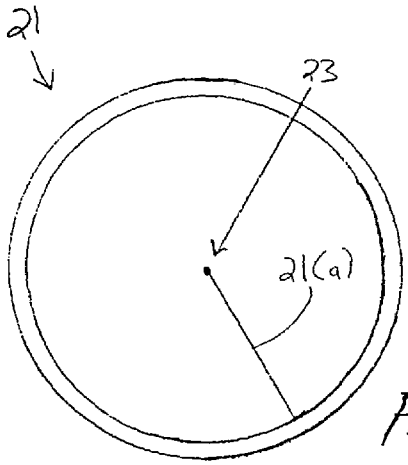

Piston 15 is preferably configured to cooperate with paste reservoir 16 and thus is also cylindrical in configuration as may be seen from a general inspection of FIG. 14. Piston 15 thus preferably comprises a paste-engaging surface 24 as illustrated and referenced in FIGS. 3 and 14; an atmospheric surface (not specifically shown) opposite paste-engaging surface 24, and a reservoir-engaging surface 25 as illustrated and referenced in FIGS. 3 and 14. It will be understood from an inspection of the noted figures that reservoir-engaging surface 25 preferably extends from paste-engaging surface 24 to the atmospheric surface opposite paste-engaging surface. Piston 15 is thus preferably received in paste reservoir 16 and movable intermediate bottom end 19 and housing end 20. General knowledge of pistons and cylinders incorporating the use thereof are believed to be well within the ordinary skill of those in the art. However, it is worth noting that reservoir-engaging surface 25 snugly contacts the inner reservoir surface along the entire reservoir height 22 and thus piston 15 may be defined as being piston-received in paste reservoir 16. It should be noted that bottom end 19 preferably comprises atmospheric pressure maintenance means, which means function to maintain atmospheric pressure intermediate bottom end 19 and the atmospheric surface. In this regard, it is contemplated that the atmospheric pressure maintenance means may preferably be defined by at least one aperture formed in the structure of bottom end 19, which aperture functions to maintain atmospheric pressure.

Figure 8:
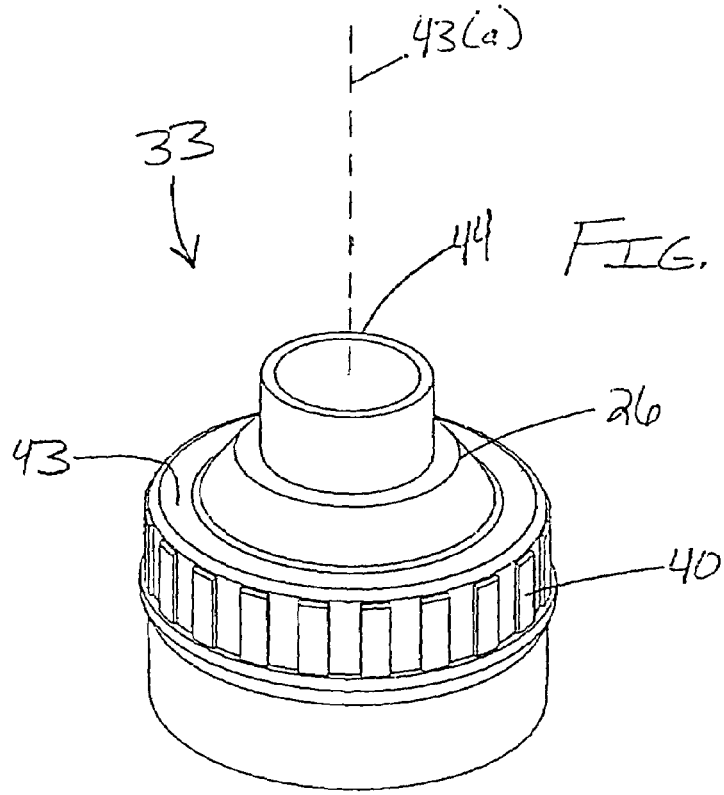
FIG. 8 is a top perspective view of a pump member of the toothbrush assembly.
Figure 8A:
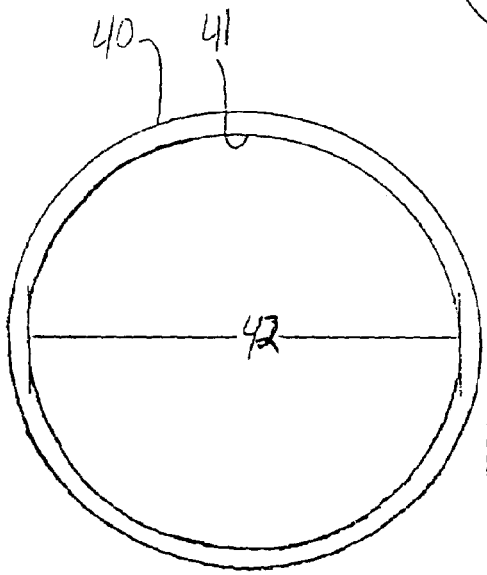
Figures 13, 13A, 13B, 13C:
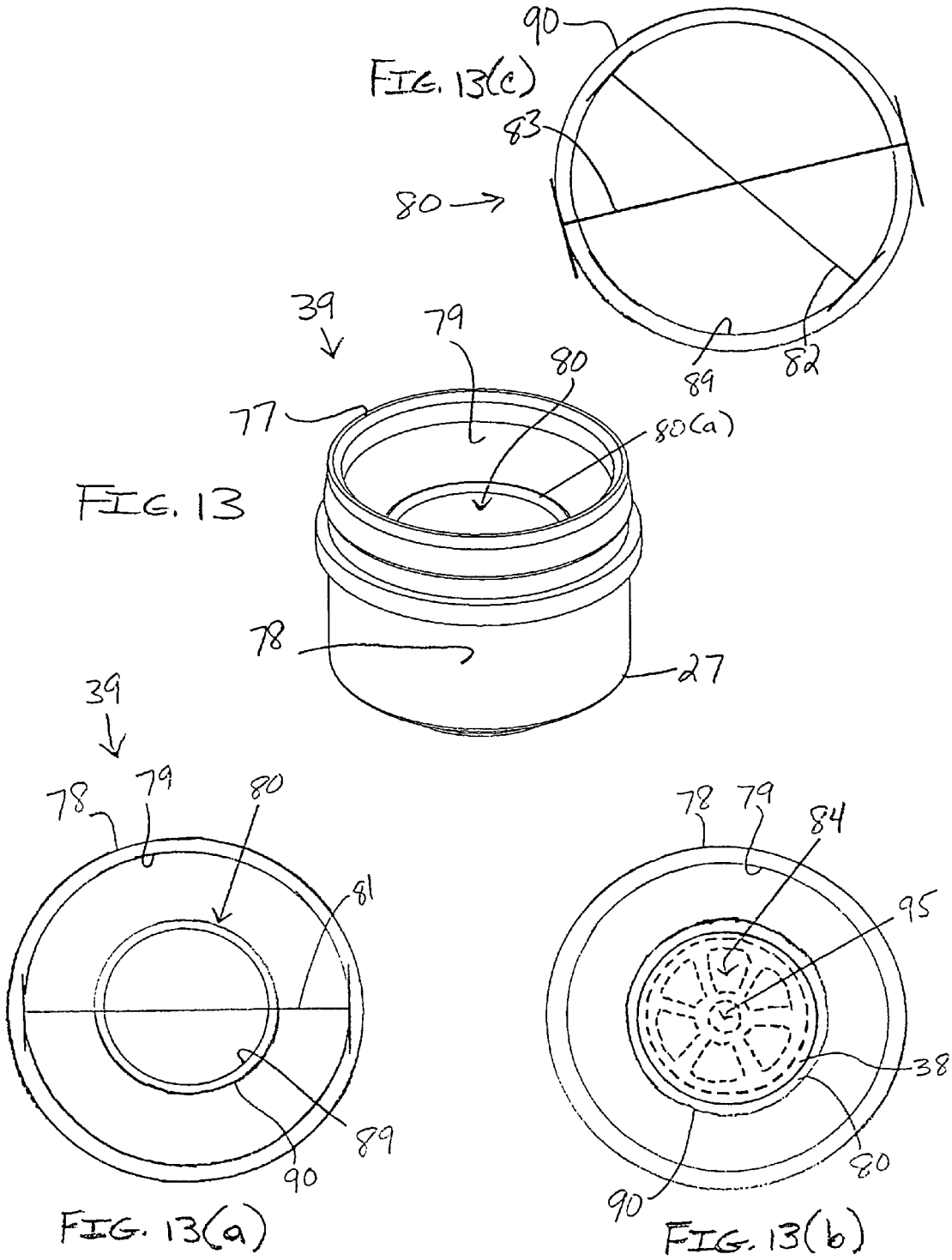
FIG. 13 is a top perspective view of a pump housing of the toothbrush assembly.

Paste pump assembly 14 essentially comprises a brush-engaging end 26 as illustrated and referenced in FIGS. 1, 3, and 8; a reservoir-engaging end 27 as illustrated and referenced in FIGS. 1, 3, and 13; and paste conduit means. The paste conduit means preferably extends from reservoir-engaging end 27 to brush-engaging end 26 for conveying paste from paste reservoir 16 to paste-dispensing brush 13. It will be seen from an inspection of FIG. 3 that reservoir-engaging end 27 is cooperatively associated with housing end 20 for creating an initial paste pressure intermediate paste-engaging surface 24 and reservoir-engaging end 27. In this regard, it will be understood that reservoir-engaging end 27 is snugly received in housing end 20 so that fluids contained within paste reservoir 16 are subject to displacement only through the paste conduit means and not intermediate reservoir-engaging surface 25 and inner reservoir surface 17 nor intermediate the outer surface of reservoir-engaging end 27 and inner reservoir surface 17. Piston 15 is thus preferably movable intermediate bottom end 19 and housing end 20 for moving paste generally in the direction of the paste conduit means.

Figure 9:
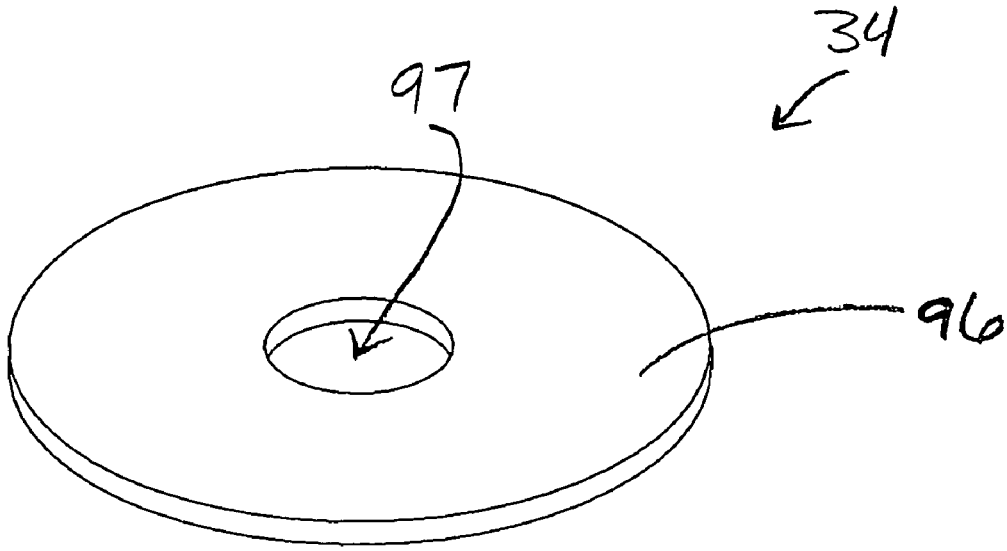
FIG. 9 is a top perspective view of a pump diaphragm of the toothbrush assembly.
Figures 10, 10A, 10B:
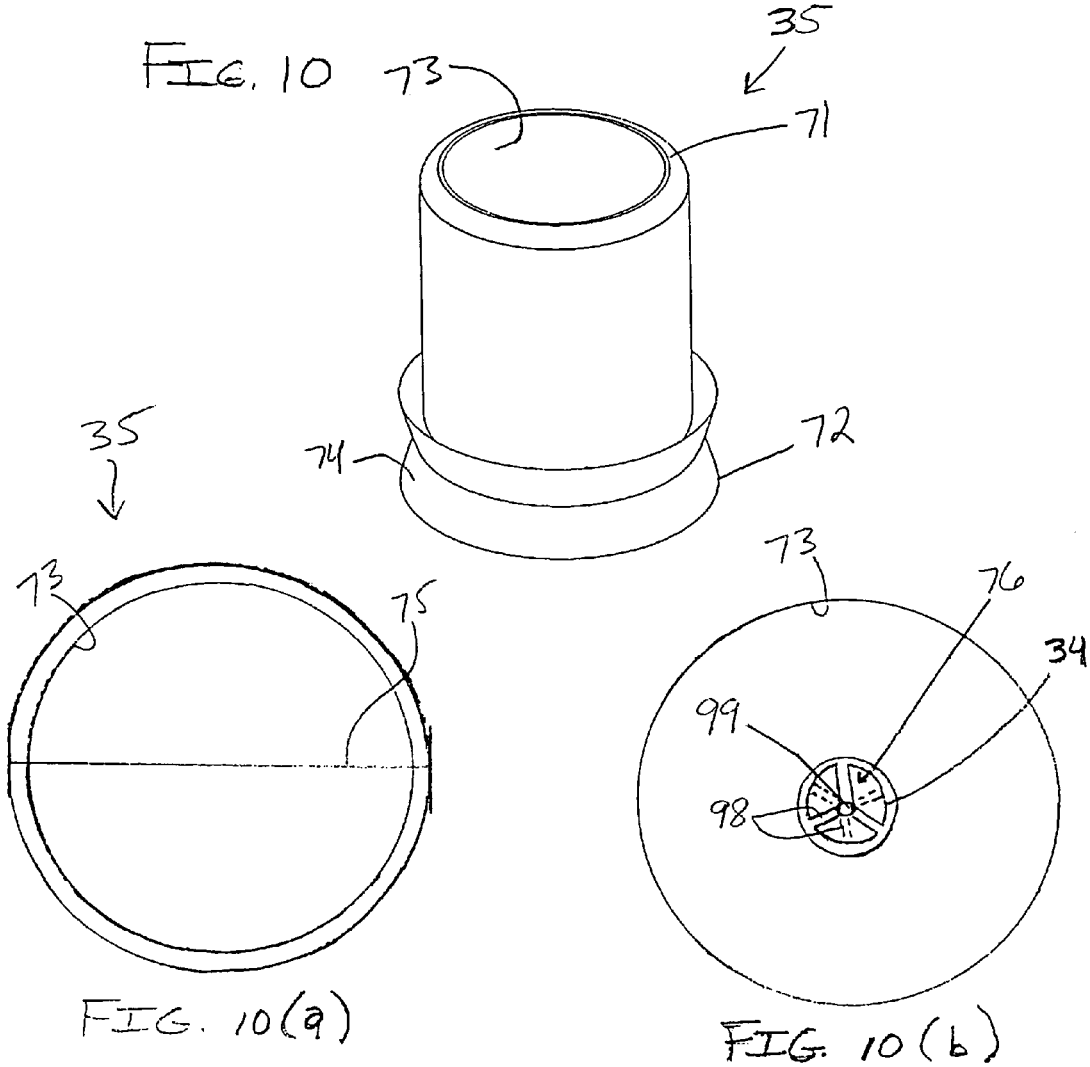
FIG. 10 is a top perspective view of a plunger of the toothbrush assembly.
Figure 11:
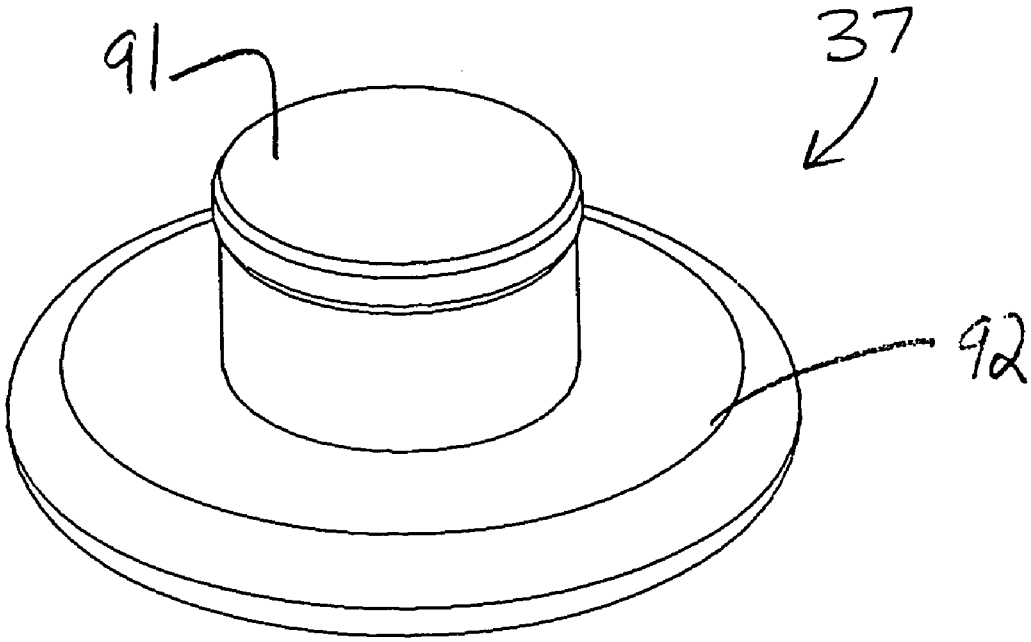
FIG. 11 is a bottom perspective view of a plug of the toothbrush assembly.
Figure 12:
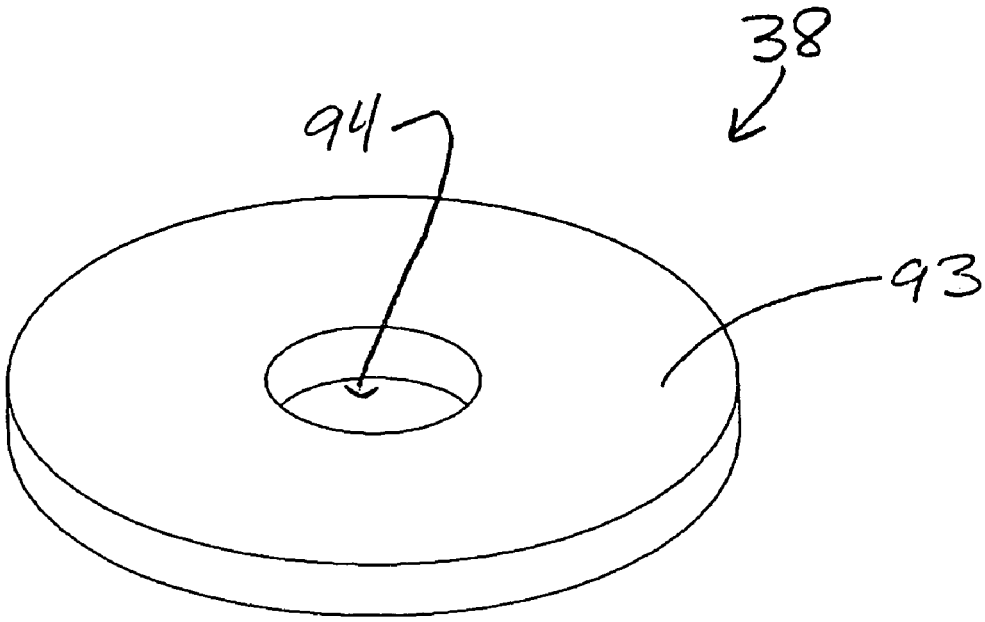
FIG. 12 is a top perspective view of a housing diaphragm of the toothbrush assembly.
Figure 16:
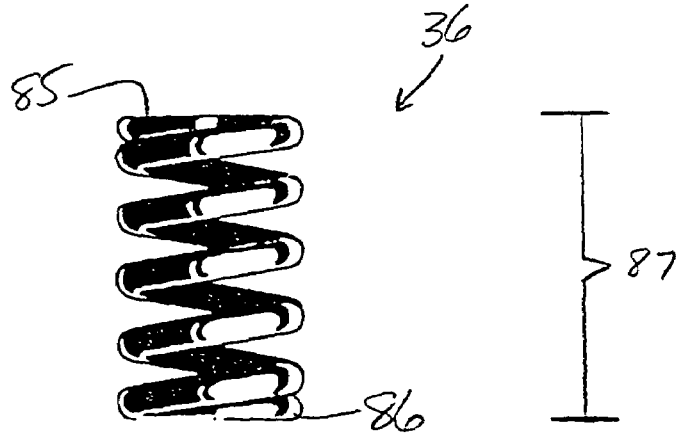
FIG. 16 is a side plan view of a compression coil of the toothbrush assembly.
Figure 17:
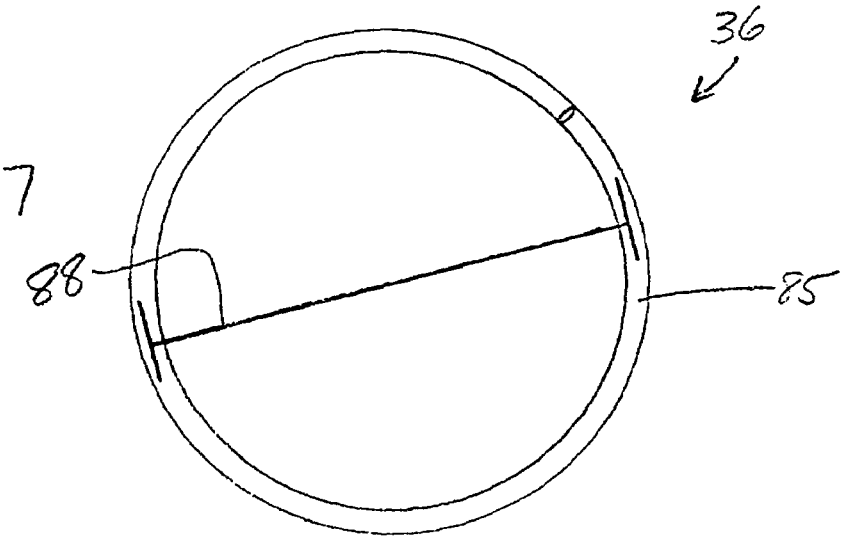
FIG. 17 is an enlarged top plan view of the compression coil shown in FIG. 16.

Paste pump assembly 14 preferably comprises a manually-operable pump member 33 as illustrated and referenced in FIGS. 3 and 8; a pump diaphragm 34 as illustrated and referenced in FIGS. 3, 9, and 10(*b*); a plunger 35 as illustrated and referenced in FIGS. 3, and 10; a compression coil 36 as illustrated and referenced in FIGS. 3, 16, and 17, a plug 37 as illustrated and referenced in FIGS. 3 and 11; a housing diaphragm 38 as illustrated and referenced in FIGS. 3, 12, and 13(*c*); and a pump housing 39 as illustrated and referenced in FIGS. 3 and 13. Pump member 33 preferably comprises a housing-engaging or housing-engageable outer pump surface 40 as illustrated and referenced in FIGS. 8 and 8(*a*); a plunger-covering inner pump surface 41 as illustrated and referenced in FIG. 8(*a*); a circular transverse pump cross-section as generally illustrated in FIG. 8(*a*); and brush-engaging end 26 as earlier described. Having a circular cross-section in the preferred embodiment, the pump cross-section has an inner pump diameter 42 as generally referenced in FIG. 8(*a*). Brush-engaging end 26 preferably comprises a lid-receiving seat 43 as illustrated and referenced in FIGS. 3 and 8; and a pump paste gateway 44 as illustrated and referenced in FIGS. 3 and 8.

Figure 7:
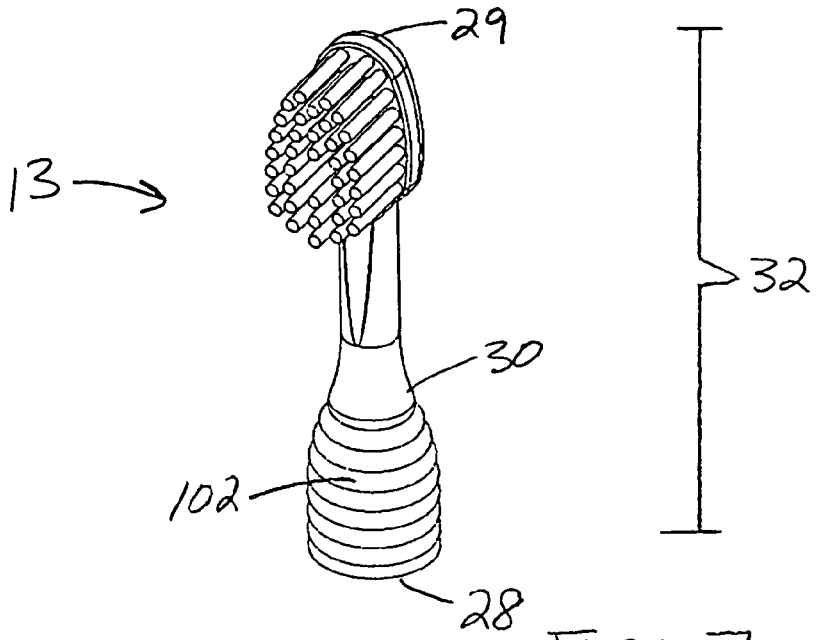
FIG. 7 is a top perspective view of a paste-dispensing brush of the toothbrush assembly.
Figure 7A:
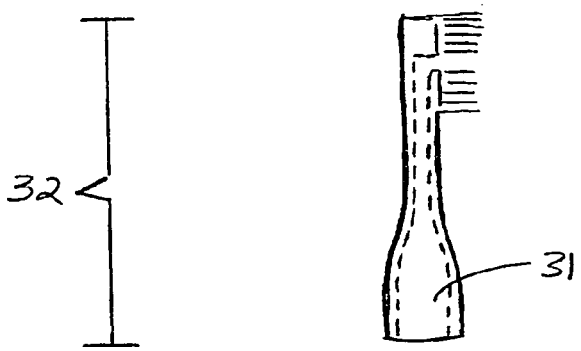

Paste-dispensing brush 13 preferably comprises a pump-engaging end 28 as illustrated and referenced in FIGS. 1, 3, and 7; a brush head 29 as illustrated and referenced in FIGS. 1–3, and 7; an outer brush surface 30 as referenced in FIG. 7; a brush conduit 31 as illustrated and referenced in FIG. 7(*a*); and a brush height as generally referenced at 32 in FIGS. 7 and 7(*a*). Brush conduit 31 defines an inner brush surface or inner brush tunnel for conveying paste from brush-engaging end 26 to brush head 29. It should be understood that pump-engaging end 28 is preferably cooperatively associated with brush-engaging end 26 so that brush conduit 31 may function to receive paste from brush-engaging end and 26 and deliver same to brush head 29. Brush head 29 preferably comprises a series of bristles formed adjacent brush conduit 31.

Figure 4:
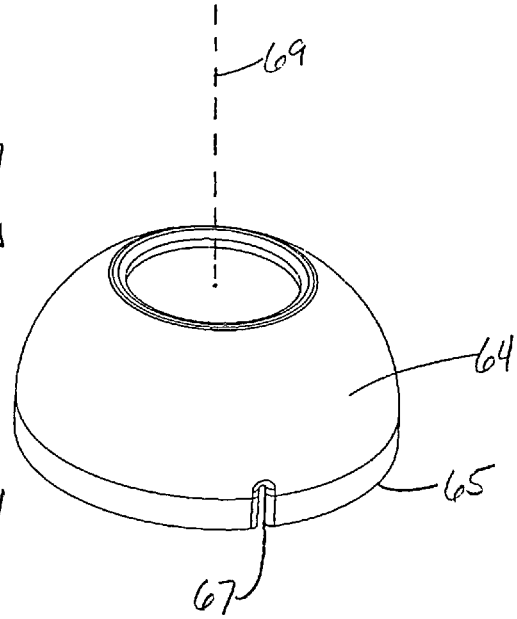
FIG. 4 is a top perspective view of a floss cap of the floss assembly.
Figure 4A:
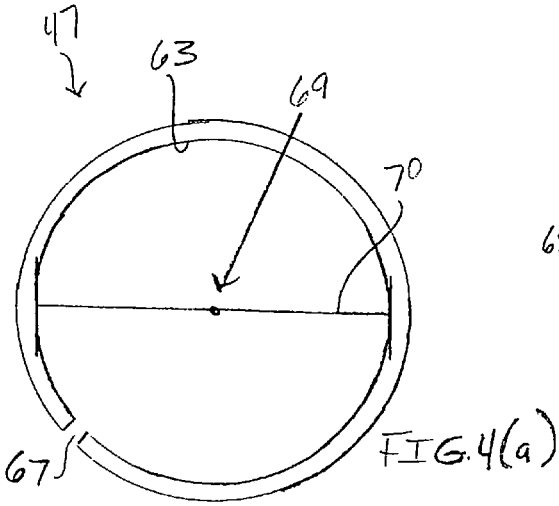
Figure 4B:
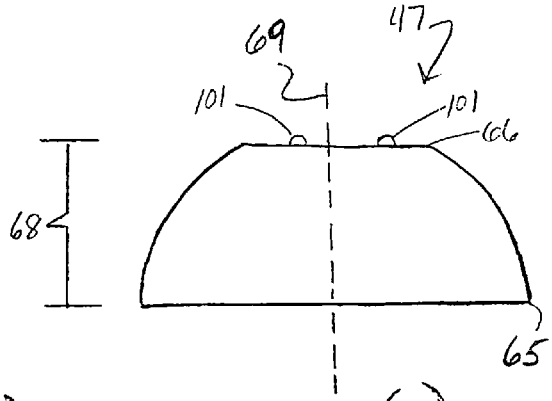
Figure 5:
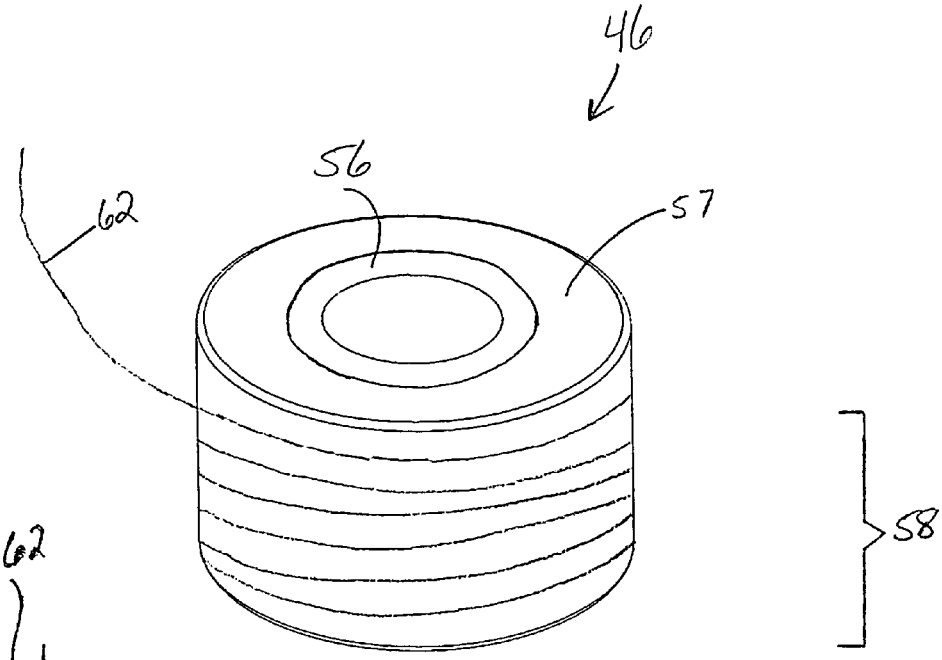
FIG. 5 is a top perspective view of a floss spool of the floss assembly.
Figure 5A:
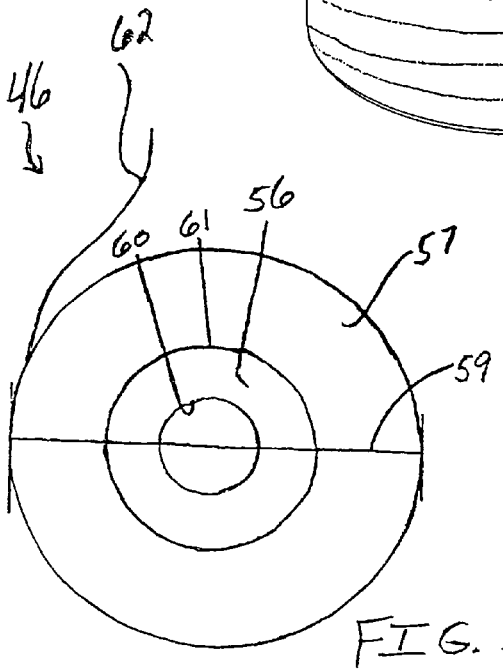
Figures 6, 6A:
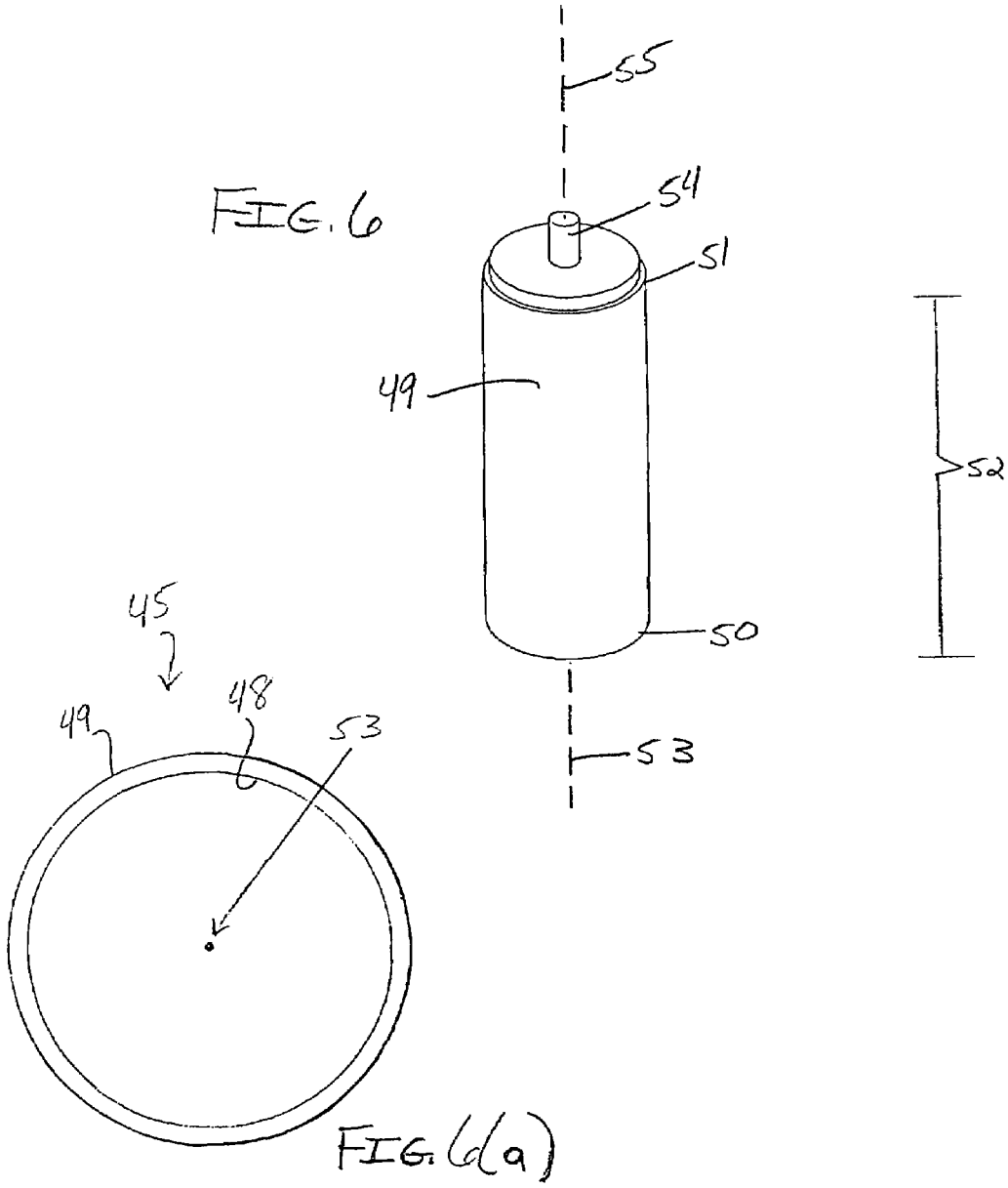
FIG. 6 is a top perspective view of a spool-supporting lid of the floss assembly.

Floss assembly 12 preferably comprises a spool-supporting lid 45 as illustrated and referenced in FIGS. 1, 3, 6, and 6(*a*); a floss spool 46 as illustrated and referenced in FIGS. 1–3, 5, and 5(*a*); and a floss cap 47 as illustrated and referenced in FIGS. 1, 3, 4, 4(*a*) and 4(*b*). Spool-supporting lid 45 preferably comprises a brush-covering inner lid surface 48 as illustrated and referenced in FIG. 6(*a*); an outer lid surface 49 as illustrated and referenced in FIGS. 3, 6, and 6(*a*); a seat-engaging end 50 as illustrated and referenced in FIGS. 3 and 6; a spool-supporting end 51 as illustrated and referenced in FIGS. 3 and 6; a circular transverse lid cross-section as generally illustrated in FIG. 6(*a*); a lid height as generally referenced at 52 in FIG. 6; and a central longitudinal lid axis as generally referenced at 53 in FIGS. 6 and 6(*a*). Seat-engaging end 50 is preferably removably receivable by or removable seatable upon brush-engaging end 26 as generally depicted in FIG. 3. Notably, brush height 32 is lesser in magnitude than lid height 52. In this last regard, it will be understood that inner lid surface 48 functions to cover or surround paste-dispensing brush 13. It will be seen from an inspection of FIG. 6 that spool-supporting end 51 preferably comprises a spool-receiving post 54, which spool-receiving post 54 preferably comprises a post height and a central longitudinal post axis as referenced at 55. Spool-receiving post 54 is preferably integrally formed with outer lid surface 49 adjacent spool-supporting end 51.

Floss spool 46 preferably comprises a post-receiving member 56 as illustrated and referenced in FIGS. 5 and 5(*a*); a floss length 57 as illustrated and referenced in FIGS. 5 and 5(*a*); a spool height as generally referenced at 58 in FIG. 5; and an outer spool diameter as referenced at 59 in FIG. 5(*a*). Post-receiving member 56 preferably comprises a post-receiving inner surface 60 and a floss-receiving outer surface 61 both as referenced in FIG. 5(*a*). Floss length 57 is thus preferably spooled upon and adjacent floss-receiving outer surface 61 and preferably comprises a floss length end 62 as referenced in FIGS. 5 and 5(*a*). Post 54 preferably receives post-receiving inner surface 60 and spool-supporting end 51 thus supports floss spool 46.

Floss cap 47 preferably comprises a spool-covering inner cap surface 63 as referenced in FIG. 4(*a*); an outer cap surface 64 as illustrated and referenced in FIGS. 1, 3, and 4; a support-engaging end 65 as illustrated and referenced in FIGS. 3, 4, and 4(*b*); a top end 66 as illustrated and referenced in FIGS. 1, 3, and 4(*b*); a floss-receiving groove 67 (or floss provision means) as illustrated and referenced in FIGS. 4 and 4(*a*); a circular transverse cap cross-section as generally illustrated in FIG. 4(*a*); a cap height as generally referenced at 68 in FIG. 4(*b*); and a central longitudinal cap axis as generally referenced at 69 in FIGS. 4, 4(*a*) and 4(*b*). It will be noted from a general consideration of the applicable figures and in conjunction with the exploded view as set forth in FIG. 3 that reservoir axis 23, lid axis 53, post axis 55, and cap axis 69 are preferably collinear when the noted components are in assembled relation with one another. From an inspection of FIG. 4(*a*), it will be seen that the cap cross-section has an inner cap diameter as generally referenced at 70.

Support-engaging end 65 is removably receivable by or removably seatable upon spool-supporting end 51. It will be further understood from a consideration of the various applicable figures that the post height and spool height 58 are each lesser in magnitude than cap height 68. Further, in this regard, outer spool diameter 59 is lesser in magnitude than inner cap diameter 70. Thus, inner cap surface 63 functions to cover or surround floss spool 46 as received by post 54 when cap 64 is removably seated upon spool-supporting lid 45. Floss-receiving groove 67 is formed in cap 47 so that it extends from inner cap surface 63 to outer cap surface 64. Thus, floss length end 62 may be extended through floss-receiving groove 67 for enabling a user to utilize a portion of floss length 57. It is believed well within the ordinary skill of those in the art that the portion of floss length 57 may thus be utilized for contributing to a user's oral hygiene and thus no further descriptions of how to utilize the portion of floss length 57 are here presented.

It will be understood from an inspection of FIG. 3 that when oral hygiene kit is in an assembled state, seat-engaging end 50 is removably seated upon lid-receiving seat 43 and the pump paste gateway 44 is in fluid communication with brush conduit 31. Plunger 35 preferably comprises a gateway-engaging end 71 as illustrated and referenced in FIGS. 3 and 10; a paste-pressing end 72 as illustrated and referenced in FIGS. 3 and 10; an inner plunger surface 73 as referenced in FIGS. 10–10(*b*); an outer plunger surface 74 as referenced in FIG. 10; and a circular transverse plunger cross-section as generally referenced in FIG. 10(*a*). It will be seen from an inspection of FIG. 10(*a*) that the plunger cross-section has an outer plunger diameter as referenced at 75. Paste-pressing end 72 preferably comprises a plunger paste inlet 76 as illustrated adjacent the broken lines as referenced in FIG. 10(*b*).

Pump housing 39 preferably comprises a pump-receiving end 77 as illustrated and referenced in FIGS. 3 and 13; an outer housing surface 78 as referenced in FIGS. 13–13(*b*); an inner housing surface 79 as referenced in FIGS. 13–13 (*b*); a paste channel 80 as illustrated and referenced in FIGS. 13–13(*c*); a circular transverse housing cross-section as generally depicted in FIGS. 13(*a*) and 13(*b*), and reservoir-engaging end 27 as earlier described. The housing cross-section has an inner housing diameter as referenced at 81 in FIG. 13(*a*). Paste channel 80 has a channel inlet end as generally depicted in FIG. 13(*b*); a plunger-receiving end as generally illustrated and referenced in FIG. 13 at 80(*a*); an inner channel surface 89 as illustrated and referenced in FIGS. 13(*a*) and 13(*c*); an outer channel surface 90 as illustrated and referenced in FIGS. 13(*a*)–13(*c*); and a circular transverse channel cross-section as generally depicted in FIGS. 13(*b*) and 13(*c*). The channel cross-section has an inner channel diameter as referenced at 82 and an outer channel diameter as referenced at 83 in FIG. 13(*c*). Reservoir-engaging end comprising a housing paste inlet 84 as illustrated in broken lines and as referenced in FIG. 13(*b*).

Compression coil 36 preferably comprises a pump coil end 85 as illustrated and referenced in FIGS. 3, 16, and 17; a housing coil end 86 as illustrated in FIGS. 3 and 16; a relaxed coil height or equilibrium position as referenced at 87 in FIG. 16; and a coil diameter as referenced at 88 in FIG. 17. Coil diameter 88 is greater in magnitude than outer channel diameter 83 and lesser in magnitude than inner pump diameter 41. Outer pump surface 40 is snugly received in medial adjacency to inner housing surface 79 and thus may be described as being piston-received adjacent inner housing surface 79. Outer plunger surface 74 is snugly received in medial adjacency to inner channel surface 89 and thus may be described as being piston-received adjacent inner channel surface 89. Pump coil end 85 preferably engages brush-engaging end 26 adjacent inner pump surface 41 and housing coil end 86 preferably engages reservoir-engaging end 27 adjacent inner housing surface 79.

Housing diaphragm 38 is preferably constructed from a flexible or pliable material and comprises a channel inlet surface (not specifically referenced); a channel surface 93 as referenced in FIG. 12; and a plug aperture 94 as further referenced in FIG. 12. Thus it will be seen that housing diaphragm 38 is cooperatively associated with housing paste inlet 84 for allowing the forced portion of paste to convey from paste reservoir 16 to paste channel 80. In this regard, it should be noted that plug 37 functions to secure housing diaphragm 38 to housing paste inlet 84. It will thus be seen that plug 37 comprises a plug post 91 and diaphragm-retaining structure 92 as illustrated and referenced in FIG. 11. Plug post 91 is insertable through plug aperture 94 and receivable in housing paste inlet 84 such that diaphragm-retaining structure 92 retains housing diaphragm 38 (by contacting channel surface 93) in superior adjacency to housing paste inlet 84. Plug post 91 is receivable in inlet aperture 95 as illustrated in broken lines and as referenced in FIG. 13(*b*). This arrangement is perhaps most clearly illustrated in the exploded view of FIG. 3.

Similarly, pump diaphragm 34 is preferably constructed from a flexible or pliable material and comprises a plunger inlet surface (not specifically referenced); a gateway surface 96 as referenced in FIG. 9; and a plunger post aperture 97 as further referenced in FIG. 9. A series of brackets 98 fix a plunger post 99 through plunger post aperture 97. It will be seen from an inspection of FIG. 10(*b*) that some brackets are disposed in inferior adjacency to pump diaphragm 34 (shown in broken lines) and some brackets 98 are disposed in superior adjacency to pump diaphragm 34 (shown in solid lines). Pump diaphragm 34 is thus fixed intermediate the superior and inferior brackets 98. Thus it will be seen that pump diaphragm 34 is cooperatively associated with plunger paste inlet 76 adjacent inner plunger surface 73 for allowing the forced portion of paste to convey from paste channel 80 to pump paste gateway 44. It will thus be recalled that the pump conduit means are essentially or preferably defined by housing paste inlet 84, paste channel 80, plunger paste inlet 76, and pump paste gateway 44 in conjunction with the other operable elements as herein specified. It will thus be noted that pump 43 being piston-compressible, thus compressing compression coil 36 to a paste displacement position (not specifically illustrated). Compression coil 36 is then returnable to equilibrium position 87. As compression coil 36 returns to equilibrium position 87 from the paste displacement position, the initial paste pressure tends toward a third paste pressure. The third paste pressure is lesser in magnitude than atmospheric pressure. The atmospheric pressure maintenance means, as earlier specified thus functions to exerting piston-moving pressure against piston 15 to maintain the initial paste pressure as compression coil 36 returns to equilibrium position 87. It will be readily understood from a consideration of the foregoing descriptions and drawing figures that pump 43 is manually operable or longitudinally displaceable relative to the pump axis as referenced at 43(*a*) in FIG. 8. It will be further noted that pump axis 43(*a*) is substantially collinear with reservoir axis 23, lid axis 53, post axis 55, and cap axis 69 when oral hygiene kit 10 is in an assembled state as may be seen from a general inspection of FIG. 1. The selective longitudinal displacement of pump 43 thus operates to force paste from the reservoir to the brush head via the paste conduit means.

The toothpaste or paste is preferably received in paste reservoir 16 and has an initial paste volume. Notably, the initial paste volume is substantially equal in magnitude to the initial paste-receiving volume. Pump assembly 14 is operable to increase the initial paste pressure to a second paste pressure, which second paste pressure functions to force or forces a portion of paste from paste reservoir 16 through the paste conduit means and brush conduit 31 to brush head 29. The forced portion of paste thus substantially decreases or decrements the second paste pressure to the initial paste pressure when forced from paste reservoir 16. Notably, in this last regard, the portion of paste has a paste portion volume, however lesser in magnitude as compared to the initial paste volume. Thus, it will be understood that the initial paste volume is decremented by the paste portion volume as a user manually operates pump assembly 14. Further, brush head 29 is operable to selectively apply the portion of paste for contributing to a user's oral hygiene. Together, toothbrush assembly 11 and floss assembly 12 provide oral hygiene kit 10, which kit enables a user to more effectively maintain oral hygiene.

In the preferred embodiment of the present invention, the reservoir cross-section has an outer reservoir diameter, the lid cross-section has an outer lid diameter, the cap cross-section has an outer cap diameter, and the lid-receiving seat has an outer seat diameter, the outer reservoir diameter, the outer lid diameter, the outer cap diameter, and the outer seat diameter being substantially equal in magnitude such that the outer most perimeter of a transverse cross-section of kit 10 defines the circumference as dictated by the above-noted diameters. The outer most perimeter of a transverse cross-section of kit 10 is referenced at 103 in FIG. 2. Thus, it will be understood that oral hygiene kit 10 has a substantially uniform outer kit diameter that extends from seat-engaging end 65 to bottom end 19. The outer kit diameter is preferably sized to be hand holdable and thus the outer kit diameter preferably has a hand-holdable magnitude for enhancing a user's ability to hand hold and manually operate oral hygiene kit 10.

It is further contemplated that certain optional features may be incorporated into the design of oral hygiene kit 10. In this regard, it is contemplated that the materials used in constructing paste-dispensing brush 13, pump member 33, plunger 35, pump housing 39, piston 15, paste reservoir 16, spool-supporting lid 45, and floss cap 47 may comprise injection molded plastic materials and thus form relatively rigid structures. The injection molded plastic materials may be opaque or translucent as per the manufacturer's specifications. It is contemplated, in this last regard, however, that when constructed from translucent materials, the internal elements of oral hygiene kit 10 may be viewed. Further, it is contemplated that top end 66 may preferably comprise floss-cutting means (as preferably defined by raised metal members 101, which members extend from a metal disc attached to top end 66) for enabling a user to selectively cut floss length 57. Other optional attributes of the present invention may include grip means formed at outer brush surface 30. From an inspection of FIG. 7, for example, it will be seen that paste-dispensing brush 13 comprises grip means in the form of a series of concentric, longitudinally stacked or formed ridges 102 as illustrated and referenced in FIG. 7. It is thus contemplated that the grip means may function to enhance a user's ability to grip toothbrush assembly 11. Still further, it is contemplated that oral hygiene kit 10 may optionally comprises a paste refill source for selectively refilling paste reservoir 16 when the initial paste volume has been decremented by an amount substantially equal to the paste portion volume.

It has thus been noted that oral hygiene kit may optionally comprise a paste refill source. However, it should be further noted that the oral hygiene kit 10 or paste-dispensing brush assembly, as generally described herein, may be manufactured from relatively inexpensive materials as a means to keep the costs to the consumer minimized. In this regard, it is contemplated that the kit or toothbrush assembly may be made for a single use. In other words, when the initial paste volume has been decremented to substantially zero volume, it is contemplated that the user may otherwise dispose of the kit or toothbrush assembly. Thus, it should be noted that the present invention discloses a disposable oral hygiene kit or disposable paste-dispensing toothbrush assembly. Further, it is contemplated that the present invention may function as a convenient travel kit for enabling users thereof to more effectively maintain oral hygiene, the travel kit being substantially specified by the foregoing descriptions and definitions.

Thus, while the above description contains much specificity, this specificity should not be construed as limitations on the scope of the invention, but rather as an exemplification of the invention. For example, it is believed that the spirit of the present invention discloses a paste-dispensing toothbrush assembly, optionally disposable or designed for travel, for enabling a user to maintain oral hygiene, which toothbrush assembly comprises a paste-dispensing brush, a paste pump assembly, a piston, and a paste reservoir, substantially as earlier specified. It will be recalled that the paste reservoir comprises an inner reservoir surface, an outer reservoir surface, a bottom end, a housing end, a circular transverse reservoir cross-section, a reservoir height, and a central longitudinal reservoir axis. The reservoir cross-section has an inner reservoir sectional area. The product of the inner reservoir sectional area and the reservoir height together define an initial paste-receiving volume.

The piston comprises a paste-engaging surface, an atmospheric surface, and a reservoir-engaging surface. The reservoir-engaging surface extends from the paste-engaging surface to the atmospheric surface. The piston is thus piston-received in the paste reservoir, the reservoir-engaging surface snugly contacting the inner reservoir surface. The paste pump assembly essentially comprises a brush-engaging end, a reservoir-engaging end, and paste conduit means, which conduit means extend from the reservoir-engaging end to the brush-engaging end for conveying paste from the paste reservoir to the paste-dispensing brush. The reservoir-engaging end is cooperatively associated with the housing end for creating an initial paste pressure intermediate the paste-engaging surface and the reservoir-engaging end. The piston is movable intermediate the bottom end and the housing end.

The paste-dispensing brush comprises a pump-engaging end, a brush head, an outer brush surface, a brush conduit, and a brush height. The brush conduit functions to convey paste from the brush-engaging end to the brush head. The pump-engaging end is cooperatively associated with the brush-engaging end.

Paste is receivable in the paste reservoir and thus has an initial paste volume substantially equal in magnitude to the initial paste-receiving volume. The pump assembly is operable to increase the initial paste pressure to a second paste pressure for forcing a portion of paste from the paste reservoir through the paste conduit means and the brush conduit to the brush head. The portion of paste thus decreases the second paste pressure to a pressure substantially equal to the initial paste pressure when forced from the paste reservoir. In this regard, the portion of paste has a coinciding paste portion volume. The initial paste volume is thus decremented by the paste portion volume when the pump assembly is operated. The brush head is further operable to selectively apply the portion of paste to a user's teeth and gums as a means to contribute to the user's oral hygiene. Thus, the toothbrush assembly enables a user to maintain oral hygiene.

It is contemplated that the toothbrush assembly may further comprise a floss assembly cooperatively associated therewith. The floss assembly comprises a spool-supporting lid, a floss spool, and a floss cap, the spool-supporting lid comprising a brush-covering inner lid surface, an outer lid surface, a seat-engaging end, a spool-supporting end, a circular transverse lid cross-section, a lid height, and a central longitudinal lid axis. The seat-engaging end is removably seatable upon the brush-engaging end. The brush height is lesser in magnitude than the lid height and the inner lid surface thus surrounds the paste-dispensing brush. The spool-supporting end comprises a spool-receiving post, which in turn comprises a post height and a central longitudinal post axis. The spool-receiving post is integrally formed with the outer lid surface. The floss spool comprises a floss length, a spool height, and an outer spool diameter. The floss length is spooled adjacent the post axis and comprises a floss length end. The post thus receives spooled floss length and the spool-supporting end supports the floss spool.

The floss cap comprises a spool-covering inner cap surface, an outer cap surface, a support-engaging end, a top end, floss provision means, a circular transverse cap cross-section, a cap height, and a central longitudinal cap axis. The reservoir axis, the lid axis, the post axis and the cap axis are collinear when the components are in an assembled state. The cap cross-section has an inner cap diameter. The support-engaging end is cooperatively associated with the spool-supporting end. The post height and the spool height are each lesser in magnitude than the cap height and the outer spool diameter is lesser in magnitude than the inner cap diameter. Thus, the inner cap surface surrounds the floss spool and the floss provision means enable a user to utilize a portion of the floss length, the portion of the floss length for further contributing to a user's oral hygiene.

At its very essence, the present invention discloses a paste-dispensing toothbrush assembly for enabling a user to maintain oral hygiene. The toothbrush assembly comprises a paste-dispensing brush, a uniquely configured paste pump assembly, a piston, and a paste reservoir. The paste reservoir, for example, may comprise a transverse reservoir cross-section, which cross-section has an inner reservoir sectional area. The product of the inner reservoir sectional area and the reservoir height define the initial paste-receiving volume. Further, the reservoir cross-section, the lid cross-section, the cap cross-section, and the lid-receiving seat each have a substantially uniformly sized and shaped transverse cross-section. In this regard, it is contemplated that the toothbrush assembly thus has a substantially uniform outer assembly surface extending from the seat-engaging end to the bottom end, the outer assembly surface for enhancing a user's ability to hand hold and manually operate the toothbrush assembly.

Accordingly, although the invention has been described by reference to a preferred embodiment, it is not intended that the novel assembly, apparatus, or kit be limited thereby, but that modifications thereof are intended to be included as falling within the broad scope and spirit of the foregoing disclosure, the following claims and the appended drawings.

The invention claimed is:

1. An oral hygiene kit for enabling a user to maintain oral hygiene, the oral hygiene kit comprising, in combination:

a paste-dispensing toothbrush assembly, the toothbrush assembly comprising a paste-dispensing brush, a paste pump assembly, a piston, and a paste reservoir, the paste reservoir comprising an inner reservoir surface, an outer reservoir surface, a bottom end, a housing end, a circular transverse reservoir cross-section, a reservoir height, and a central longitudinal reservoir axis, the reservoir cross-section having an inner reservoir sectional area, the product of the inner reservoir sectional area and the reservoir height defining an initial paste-receiving volume, the piston comprising a paste-engaging surface, an atmospheric surface, and a reservoir-engaging surface, the reservoir-engaging surface extending from the paste-engaging surface to the atmospheric surface, the piston being piston-received in the paste reservoir, the paste pump assembly comprising a brush-engaging end, a reservoir-engaging end, and paste conduit means, the paste conduit means extending from the reservoir-engaging end to the brush-engaging end for conveying paste from the paste reservoir to the paste-dispensing brush, the reservoir-engaging end being cooperatively associated with the housing end for creating an initial paste pressure intermediate the paste-engaging surface and the reservoir-engaging end, the paste-dispensing brush comprising a pump-engaging end, a brush head, an outer brush surface, a brush conduit, and a brush height, the brush conduit for conveying paste from the brush-engaging end to the brush head, the pump-engaging end being cooperatively associated with the brush-engaging end;

a floss assembly, the floss assembly comprising a spool-supporting lid, a floss spool, and a floss cap, the spool-supporting lid comprising a brush-converting inner lid surface, an outer lid surface, a seat-engaging end, a spool-supporting end, a circular transverse lid cross-section, a lid height, and a central longitudinal lid axis, the seat-engaging end being removably seatable upon the brush-engaging end, the brush height being lesser in magnitude than the lid height, the inner lid surface thus for surrounding the paste-dispensing brush, the spool-supporting end comprising a spool-receiving post, the spool-receiving post comprising a post height and a central longitudinal post axis, the spool-receiving post being integrally formed with the outer lid surface, the floss spool comprising a post-receiving member, a floss length, a spool height, and an outer spool diameter, the post-receiving member comprising a post-receiving inner surface and a floss-receiving outer surface, the floss length being spooled upon and adjacent the floss-receiving outer surface, the floss length comprising a floss length end, the post receiving the post-receiving inner surface, the spool-supporting end thus supporting the floss spool, the floss cap comprising a spool-covering inner cap surface, an outer cap surface, a support-engaging end, a top end, a floss-receiving groove, a circular transverse cap cross-section, a cap height, and a central longitudinal cap axis, the reservoir axis, the lid axis, the post axis and the cap axis being collinear, the cap cross-section having an inner cap diameter, the support-engaging end being removably receivable by the spool-supporting end, the post height and the spool height each being lesser in magnitude than the cap height, the outer spool diameter being lesser in magnitude than the inner cap diameter, the inner cap surface thus surrounding the floss spool, the floss-receiving groove extending from the inner cap surface to the outer cap surface, the floss length end extending through the floss-receiving groove for enabling a user to utilize a portion of the floss length, the portion of the floss length for contributing to a user's oral hygiene; and paste, the paste being received in the paste reservoir, the paste having an initial paste volume, the initial paste volume being substantially equal in magnitude to the initial paste-receiving volume, the pump assembly being operable to increase the initial paste pressure to a second paste pressure, the second paste pressure forcing a portion of paste from the paste reservoir through the paste conduit means and the brush conduit to the brush head, the portion of paste thus substantially decreasing the second paste pressure to the initial paste pressure when forced from the paste reservoir, the portion of paste having a paste portion volume, the initial paste volume being decremented by the paste portion volume, the brush head being operable to selectively apply the portion of paste for contributing to a user's oral hygiene, the toothbrush assembly and the floss assembly thus providing an oral hygiene kit for enabling a user to maintain oral hygiene.

2. The oral hygiene kit of claim 1 wherein the bottom end comprises atmospheric pressure maintenance means and the paste pump assembly comprises a manually-operable pump member, a pump diaphragm, a plunger, a compression coil, a housing diaphragm, and a pump housing, the pump member comprising a housing-engageable outer pump surface, a plunger-covering inner pump surface, a circular transverse pump cross-section, and the brush-engaging end, the pump cross-section having an inner pump diameter, the brush-engaging end comprising a lid-receiving seal and a pump paste gateway, the seat-engaging end being removably seatable upon the lid-receiving seat, the pump paste gateway being in fluid communication with the brush conduit, the plunger comprising a gateway-engaging end, a paste-pressing end, an inner plunger surface, an outer plunger surface, and a circular tranverse plunger cross-section, the plunger cross-section having an outer plunger diameter, the paste-pressing end comprising a plunger paste inlet, the pump housing comprising a pump-receiving end, an outer housing surface, an inner housing surface, a paste channel, a circular transverse housing cross-section, and the reservoir-engaging end, the housing cross-section having an inner housing diameter, the paste channel having a channel inlet end, a plunger-receiving end, an inner channel surface, an outer channel surface, and a circular transverse channel cross-section, the channel cross-section having an inner channel and an outer channel diameter, the reservoir-engaging end comprising a housing paste inlet, the compression coil having a pump coil end, a housing coil end, an equilibrium position, and a coil diameter, the coil diameter being greater in magnitude than the outer channel diameter and lesser in magnitude than the inner pump diameter, the outer pump surface being piston-received adjacent the inner housing surface, the outer plunger surface being piston-received adjacent the inner channel surface, the pump coil end engaging the brush-engaging end, the housing coil end engaging the reservoir-engaging end, the housing diaphragm being cooperatively associated with the housing paste inlet for allowing the forced portion of paste to convey from the paste reservoir to the paste channel, the pump diaphragm being cooperatively associated with the plunger paste inlet adjacent the inner plunger surface for allowing the forced portion of paste to convey from the paste channel to the pump paste gateway, the pump conduit means thus being defined by the housing paste inlet, the paste channel, the plunger paste inlet, and the pump paste gateway, the pump being piston-compressible, the pump thus compressing the compression coil to a paste displacement position, the compression coil returnable to the equilibrium position, the initial paste pressure tending toward a third paste pressure when the compression coil returns to the equilibrium position, the third paste pressure being lesser in magnitude than atmospheric pressure, the atmospheric pressure maintenance means for exerting piston-moving pressure against the piston to maintain the initial paste pressure as the compression coil returns to the equilibrium position.

3. The oral hygiene kit of claim 2 wherein the reservoir cross-section has an outer reservoir diameter, the lid cross-section has an outer lid diameter, the cap cross-section has an outer cap diameter, and the lid-receiving seat has an outer seat diameter, the outer reservoir diameter, the outer lid diameter, the outer cap diameter, and the outer seat diameter being substantially equal in magnitude, the oral hygiene kit thus having a substantially uniform outer kit diameter extending from the seat-engaging end to the bottom end, the outer kit diameter having a hand-holdable magnitude, the outer kit diameter thus for enhancing a user's ability to hand hold and manually operate the oral hygiene kit.

4. The oral hygiene kit of claim 2 wherein the paste-dispensing brush, the pump member, the plunger, the pump housing, the piston, the paste reservoir, the spool-supporting lid, and the floss cap are constructed from translucent materials, the translucent materials for enabling a user to view internal elements of the oral hygiene kit.

5. The oral hygiene kit of claim 1 wherein the top end comprises floss-cutting means, the floss-cutting means enabling a user to selectively cut the floss length.

6. The oral hygiene kit of claim 1, wherein the outer brush surface comprises grip means, the grip means for enhancing a user's ability to grip the toothbrush assembly.

7. A paste-dispensing toothbrush assembly for enabling a user to maintain oral hygiene, the toothbrush assembly comprising, in combination:

a paste-dispensing brush, a paste pump assembly, a piston, and a paste reservoir, the paste reservoir comprising an inner reservoir surface, and outer reservoir surface, a bottom end, a housing end, a circular transverse reservoir cross-section, a reservoir height, and a central longitudinal reservoir axis, the reservoir cross-section having an inner reservoir sectional area, the product of the inner reservoir sectional area and the reservoir height defining an initial paste-receiving volume, the piston comprising a paste-engaging surface, an atmospheric surface, and a reservoir-engaging surface, the reservoir-engaging surface extending from the paste-engaging surface to the atmospheric surface, the piston being piston-received in the paste reservoir, the paste pump assembly comprising a brush-engaging end, a reservoir-engaging end, paste conduit means, and a pump axis, the paste conduit means extending from the reservoir-engaging end to the brush-engaging end for conveying paste from the paste reservoir to the paste-dispensing brush, the reservoir-engaging end being cooperatively associated with the housing end for creating an initial paste pressure intermediate the paste-engaging surface and the reservoir-engaging end, the paste-dispensing brush comprising a pump-engaging end, a brush head, an outer brush surface, a brush conduit, and a brush height, the brush conduit for conveying paste from the brush-engaging end to the brush head, the pump-engaging end being cooperatively associated with the brush-engaging end, the bottom end comprising atmospheric pressure maintenance means and the paste pump assembly comprises a manually-operable pump member, a pump diaphragm, a plunger, a compression coil, a housing diaphragm, and a pump housing, the pump member comprising a housing-engageable outer pump surface, a plunger-covering inner pump surface, a circular transverse pump cross-section, and the brush-engaging end, and the pump cross-section having an inner pump diameter, the brush-engaging end comprising a lid-receiving seat and a pump paste gateway, the seat-engaging end removably seatable upon the lid-receiving seat, the pump paste gateway being in fluid communication with the brush conduit, the plunger comprising a gateway-engaging end, a paste-pressing end, an inner plunger surface, an outer plunger surface, and a circular transverse plunger cross-section, the plunger cross-section having an outer plunger diameter, the paste-pressing end comprising a plunger paste inlet, the pump hushing comprising a pump-receiving end, an outer housing surface, an inner housing surface, a paste channel, a circular transverse housing cross-section, and the reservoir-engaging end, the housing cross-section having an inner housing diameter, the paste channel having a channel inlet end, a plunger-receiving end, and a circular transverse channel cross-section having an inner channel diameter and an outer channel diameter, the reservoir-engaging end comprising a housing paste inlet, the compression coil having a pump coil end, a housing coil end, an equilibrium position, and a coil diameter, the coil diameter being greater in magnitude than the outer channel diameter and lesser in magnitude than the inner pump diameter, the outer pump surface being piston-received adjacent the inner housing surface, the outer plunger surface being piston-received adjacent the inner channel surface, the pump coil end engaging the brush-engaging end, the housing coil end engaging the reservoir-engaging end; and paste, the paste being received in the paste reservoir, the paste having an initial paste volume, the initial paste volume being substantially equal in magnitude to the initial paste-receiving volume, the pump assembly being longitudinally displaceable relative to the pump axis to increase the initial paste pressure to a second paste pressure, the second paste pressure forcing a portion of paste from the paste reservoir through the paste conduit means and the brush conduit to the brush head, the portion of paste thus substantially decreasing the second paste pressure to the initial paste pressure when forced from the paste reservoir, the portion of paste having a paste portion volume, the initial paste volume being decremented by the paste portion volume, the housing diaphragm being cooperatively associated with the housing paste inlet for allowing the forced portion of paste to convey from the paste reservoir to the paste channel, the pump diaphragm being cooperatively associated with the plunger paste inlet adjacent the inner plunger surface for allowing the forced portion of paste to convey from the paste channel to the pump paste gateway, the pump conduit means thus being defined by the housing paste inlet, the paste channel, the plunger paste inlet, and the pump paste gateway, the pump being piston-compressible, the pump thus compressing the compression coil to a paste displacement position, the compression coil returnable to the equilibrium position, the initial paste pressure tending toward a third paste pressure when the compression coil returns to the equilibrium position, the third paste pressure being lesser in magnitude than atmospheric pressure, the atmospheric pressure maintenance means for exerting piston-moving pressure against the piston to maintain the initial paste pressure as the compression coil returns to the equilibrium position, the brush head being operable to selectively apply the portion of paste, the portion of paste for contributing to a user's oral hygiene, the toothbrush assembly thus enabling a user to maintain oral hygiene.

8. The toothbrush assembly of claim 7 wherein the toothbrush assembly comprises a floss assembly, the floss assembly comprising a spool-supporting lid, a floss spool, and a floss cap, the spool-supporting lid comprising a brush-covering inner lid surface, an outer lid surface, a seat-engaging end, a spool-supporting end, a circular transverse lid cross-section, a lid height, and a central longitudinal lid axis, the seat-engaging end being removable seatable upon the brush-engaging end, the brush height being lesser in magnitude than the lid height, the inner lid surface thus for surrounding the paste-dispensing brush, the spool-supporting end comprising a spool-receiving post, the spool-receiving post comprising a post height and a central longitudinal post axis, the spool-receiving post being integrally formed with the outer lid surface, the floss spool comprising a floss length, a spool height, and an outer spool diameter, the floss length being spooled adjacent the post axis, the floss length comprising a floss length end, the post receiving the spooled floss length, the spool-supporting end thus supporting the floss spool, the floss cap comprising a spool-covering inner cap surface, an outer cap surface, a support-engaging end, a top end, floss provision means, a circular transverse cap cross-section, a cap height, and a central longitudinal cap axis, the reservoir axis, the lid axis, the post axis and the cap axis being coillinear, the cap cross-section having an inner cap diameter, the support-engaging end being cooperatively associated with the spool-supporting end, the post height and the spool height each being lesser in magnitude than the cap height, the outer spool diameter being lesser in magnitude than the inner cap diameter, the inner cap surface thus for surrounding the floss spool, the floss provisions means for enabling a user to utilize a portion of the floss length, the portion of the floss length for contributing to a user's oral hygiene.

9. The toothbrush assembly of claim 8 wherein the top end comprises floss-cutting means, the floss-cutting means enabling a user to selectively cut the floss length.

10. The toothbrush assembly of claim 8 wherein the paste-dispensing brush, the pump member, the plunger, the pump housing, the piston, the paste reservoir, the spool-supporting lid, and the floss cap are constructed from translucent materials, the tranlucent materials for enabling a user to view internal elements of the toothbrush assembly.

11. The toothbrush assembly of claim 8 wherein the reservoir cross-section has an outer reservoir diameter, the lid cross-section has an outer lid diameter, the cap cross-section has an outer cap diameter, and the lid-receiving seat has an outer seat diameter, the outer reservoir diameter, the outer lid diameter, the outer cap diameter, and the outer seat diameter being substantially equal in magnitude, the toothbrush assembly thus having a substantially uniform outer assembly diameter extending from the seat-engaging end to the bottom end, the outer assembly diameter having a hand-holdable magnitude, the outer assembly diameter thus for enhancing a user's ability to hand hold and manually operate the toothbrush assembly.

12. A paste-dispensing toothbrush assembly for enabling a user to maintain oral hygiene, the toothbrush assembly comprising a paste-dispensing brush, a paste pump assembly, a piston, and a paste reservoir, the paste reservoir comprising an inner reservoir surface, an outer reservoir surface, a bottom end, a housing end, a transverse reservoir cross-section, a reservoir height, and a central longitudinal reservoir axis, the reservoir cross-section having an inner reservoir sectional area, the product of the inner reservoir sectional area and the reservoir height defining an initial paste-receiving volume, the piston comprising a paste-engaging surface, and an atmospheric surface, the piston being piston-received in the paste reservoir, the paste pump assembly comprising a brush-engaging end, a reservoir-engaging end, paste conduit means, and a pump axis, the paste conduit means extending from the reservoir-engaging end to the brush-engaging end for conveying paste from the paste reservoir to the paste-dispensing brush, the reservoir-engaging end being cooperatively associated with the housing end for creating an initial paste pressure intermediate the paste-engaging surface and the reservoir-engaging end, the paste-dispensing brush comprising a pump-engaging end, a brush head, and a brush conduit, the brush conduit for conveying paste from the brush-engaging end to the brush head, the pump-engaging end being cooperatively associated with the brush-engaging end, the paste reservoir for receiving an initial paste volume, the initial paste pressure being associated with the initial paste volume, the initial paste volume being substantially equal in magnitude to the initial paste-receiving volume, the pump assembly being longitudinally displaceable relative to the pump axis to increase the initial paste pressure to a second paste pressure, the second paste pressure for forcing a portion of paste from the paste reservoir through the paste conduit means and the brush conduit to the brush head, the portion of paste thus substantially decreasing the second paste pressure to the initial paste pressure when forced from the paste reservoir, the bottom end comprising atmospheric pressure maintenance means and the paste pump assembly comprising a manually-operable pump member, a pump diaphragm, a plunger, a compression coil, a housing diaphragm, and a pump housing, the pump member comprising a housing-engageable outer pump surface, a plunger-covering inner pump surface, a transverse pump cross-section, and the brush-engaging end, the pump cross-section having a maximum inner pump dimension, the brush-engaging end comprising a lid-receiving seat and a pump paste gateway, the seat-engaging end removably seatable upon the lid-receiving seat, the pump paste gateway being in fluid communication with the brush conduit, the plunger comprising a gateway-engaging end, a paste-pressing end, an inner plunger surface, an outer plunger surface, and a transverse plunger cross-section, the plunger cross-section having a maximum outer plunger dimension, the paste-pressing end comprising a plunger paste inlet, the pump housing comprising a pump-receiving end, an outer housing surface, an inner housing surface, a paste channel, a transverse housing cross-section, and the housing cross-section having a maximum inner housing dimension, the paste channel having a channel inlet end, a plunger-receiving end, and a transverse channel cross-section, the channel cross-section having a maximum inner channel dimension and a maximum outer channel dimension, the reservoir-engaging end comprising a housing paste inlet, the compression coil having a pump coil end, a housing coil end, an equilibrium position, and a transverse coil area, the coil area having a maximum coil dimension, the maximum coil dimension being greater in magnitude than the maximum outer channel dimension and lesser in magnitude than the maximum inner pump dimension, the outer pump surface being piston-received adjacent the inner housing surface, the outer plunger surface being piston-received adjacent the inner channel surface, the pump coil end engaging the brush-engaging end, the housing coil end engaging the reservoir-engaging end, the housing diaphragm being cooperatively associated with the housing paste inlet for allowing the forced portion of paste to convey from the paste reservoir to the paste channel, the pump diaphragm being cooperatively associated with the plunger paste inlet adjacent the inner plunger surface for allowing the portion of paste to convey from the paste channel to the pump paste gateway, the pump conduit means thus being defined by the housing paste inlet, the paste channel, the plunger paste inlet, and the pump paste gateway, the pump being piston-compressible, the pump thus compressing the compression coil to a paste displacement position, the compression coil returnable to the equilibrium position, the initial paste pressure tending toward a third paste pressure when the compression coil returns to the equilibrium position, the third paste pressure being lesser in magnitude than atmospheric pressure, the atmospheric pressure maintenance means for exerting piston-moving pressure against the piston to maintain the initial paste pressure as the compression coil returns to the equilibrium position, the brush head being operable to selectively apply the portion of paste, the portion of paste for selectively contributing to a user's oral hygiene, the toothbrush assembly thus enabling a user to maintain oral hygiene.

13. A paste-dispensing toothbrush assembly for enabling a user to maintain oral hygiene, the toothbrush assembly comprising a paste-dispensing brush, a paste pump assembly, a piston, and a paste reservoir, the paste reservoir comprising an inner reservoir surface, an outer reservoir surface, a bottom end, a housing end, a transverse reservoir cross-section, a reservoir height, and a central longitudinal reservoir axis, the reservoir cross-section having an inner reservoir sectional area, the product of the inner reservoir sectional area and the reservoir height defining an initial paste-receiving volume, the piston comprising a paste-engaging surface, and an atmospheric surface, the piston being piston-received in the paste reservoir, the paste pump assembly comprising a brush-engaging end, a reservoir-engaging end, paste conduit means, and a pump axis, the paste conduit means extending from the reservoir-engaging end to the brush-engaging end for conveying paste from the paste reservoir to the paste-dispensing brush, the reservoir-engaging end being cooperatively associated with the housing end for creating an initial paste pressure intermediate the paste-engaging surface and the reservoir-engaging end, the paste-dispensing brush comprising a pump-engaging end, a brush head, and a brush conduit, the brush conduit for conveying paste from the brush-engaging end to the brush head, the pump-engaging end being cooperatively associated with the brush-engaging end, the paste reservoir for receiving an initial paste volume, the initial paste pressure being associated with the initial paste volume, the initial paste volume being substantially equal in magnitude to the initial paste-receiving volume, the pump assembly being longitudinally displaceable relative to the pump axis to increase the initial paste pressure to a second paste pressure, the second paste pressure for forcing a portion of paste from the paste reservoir through the paste conduit means the brush conduit to the brush head, the portion of paste thus substantially decreasing the second paste pressure to the initial paste pressure when forced from the paste reservoir, the toothbrush assembly comprising a floss assembly, a floss assembly, the floss assembly comprising a spool-supporting lid, a floss spool, and a floss cap, the spool-supporting lid comprising a brush-covering inner lid surface, a seat-engaging end, a spool-supporting end, a transverse lid cross-section, and a central longitudinal lid axis, the seat-engaging end being removably seatable upon the brush-engaging end, the inner lid surface for surrounding the paste-dispensing brush, the spool-supporting end comprising a spool-receiving post, the spool-receiving post comprising a central longitudinal post axis, the spool-receiving post being cooperatively associated with the outer lid surface, the floss spool comprising a floss length, a spool height, and an outer spool diameter, the floss length being spooled adjacent the post axis, the floss length comprising a floss length end, the post receiving the spooled floss length, the spool-supporting end thus supporting the floss spool, the floss cap comprising a spool-covering inner cap surface, an outer cap surfae, a support-engaging end, a top end, floss provision means, a transverse cap cross-section, and a central longitudinal cap axis, the reservoir axis, the lid axis, the post axis and the cap axis being collinear, the support-engaging end being cooperatively associated with the spool-supporting end, the inner cap surface for surrounding the floss spool, the floss provision means for enabling a user to utilize a floss length portion, the floss length portion for contributing to a user's oral hygiene, the brush head being operable to selectively apply the portion of paste, the portion of paste for selectively contributing to a user's oral hygiene, the toothbrush assembly thus enabling a user to maintain oral hygiene.

14. The toothbrush assembly of claim 13 wherein the reservoir cross-section, the lid cross-section, the cap cross-section, and the lid-receiving seat each have a substantially uniformly sized and shaped transverse cross-section, the toothbrush assembly thus having a substantially uniform outer assembly surface extending from the seat-engaging end to the bottom end, the outer assembly surface for enhancing a user's ability to hand hold and manuallly operate the toothbrush assembly.

15. The toothbrush assembly of claim 13 wherein the paste-dispensing brush, the pump member, the plunger, the pump housing, the piston, the paste reservoir, the spool-supporting lid, and the floss cap are constructed from translucent materials for enabling a user to view internal elements of the toothbrush assembly.

16. A paste-dispensing toothbrush assembly for enabling a user to maintain oral hygiene, the toothbrush assembly comprising, in combination:

a paste-dispensing brush, a paste pump assembly, a piston, a paste reservoir, and paste, the paste reservoir comprising an inner reservoir surface, an outer reservoir surface, a bottom end, a housing end, a circular transverse reservoir cross-section, a reservoir height, and a central longitudinal reservoir axis, the reservoir cross-section having an inner reservoir sectional area, the product of the inner reservoir sectional area and the reservoir height defining an initial paste-receiving volume, the piston comprising a paste-engaging surface, an atmospheric surface, and a reservoir-engaging surface, the reservoir-engaging surface extending from the paste-engaging surface to the atmospheric surface, the piston being piston received in the paste reservoir, the paste pump assembly comprising a brush-engaging end, a reservoir-engaging end, and paste conduit means, the paste conduit means extending from the reservoir-engaging end to the brush-engaging end for conveying the paste from the paste reservoir to the paste-dispensing brush the reservoir-engaging end being cooperatively associated with the housing end for creating an initial paste pressure intermediate the paste-engaging surface and the reservoir-engaging end, the paste-dispensing brush comprising a pump-engaging end, a brush head, an outer brush surface, a brush conduit, and a brush height, the brush conduit for conveying the paste from the brush-engaging end to the brush head, the pump-engaging end being cooperatively associated with the brush-engaging end, the bottom end comprising atmospheric pressure maintenance means, the paste pump assembly comprising a manually-operable pump member, a pump diaphragm, a plunger, a compression coil, a housing diaphragm, and a pump housing, the pump member comprising a housing-engageable outer pump surface, a plunger-covering inner pump surface, a circular transverse pump cross-section, and the brush-engaging end, the pump cross-section having an inner pump diameter, the brush-engaging end comprising a lid-receiving seat and a pump paste gateway, the seat-engaging end removably seatable upon the lid-receiving seat, the pump paste gateway being in fluid communication with the brush conduit, the plunger comprising a gateway-engaging end, a paste-pressing end, an inner plunger surface, an outer plunger surface, and a circular transverse plunger cross-section, the plunger cross-section having an outer plunger diameter, the paste-pressing end comprising a plunger paste inlet, the pump housing comprising a pump-receiving end, an outer housing surface, an inner housing surface, a paste channel, a circular transverse housing cross-section, and the reservoir-engaging end, the housing cross-section having an inner housing diameter, the paste channel having a channel inlet end, a plunger-receiving end, and a circular transverse channel cross-section, the channel cross-section having an inner channel diameter and an outer channel diameter, the reservoir-engaging end comprising a housing paste inlet, the compression coil having a pump coil end, a housing coil end, an equilibrium position, and a coil diameter, the coil diameter being greater in magnitude than the outer channel diameter and lesser in magnitude than the inner pump diameter, the outer pump surface being piston-received adjacent the inner housing surface, the outer plunger surface being piston-received adjacent the inner channel surface, the pump coil end engaging the brush-engaging end, the housing coil end engaging the reservoir-engaging end, the housing diaphragm being cooperatively associated with the housing paste inlet for allowing the forced portion of paste to convey from the paste reservoir to the paste channel, the pump diaphragm being cooperatively associated with the plunger paste inlet adjacent the inner plunger surface for allowing the forced portion of paste to convey from the paste channel to the pump paste gateway, the pump conduit means thus being defined by the housing paste inlet, the paste channel, the plunger paste inlet, and the pump paste gateway, the pump being piston-compressible, the pump thus compressing the compression coil to a paste displacement position, the compression coil returnable to the equilibrium position, the initial paste pressure tending toward a third paste pressure when the compression coil returns to the equilibrium position, the third paste pressure being lesser in magnitude than atmospheric pressure, the atmospheric pressure maintenance mean for exerting piston-moving pressure against the piston to maintain the initial paste pressure as the compression coil returns to the equilibrium position, the paste being received in the paste reservoir, the paste having an initial paste volume, the initial paste volume being substantially equal in magnitude to the initial paste-receiving volume, the pump assembly being operable to increase the initial paste pressure to a second paste pressure, the second paste pressure forcing a portion of paste from the past reservoir through the paste conduit means and the brush conduit to the brush head, the portion of paste thus substantially decreasing the second paste pressure to the initial paste pressure when forced from the paste reservoir, the portion of paste having a paste portion volume, the initial paste volume being decremented by the paste portion volume, the brush head being operable to selectively apply the portion of paste, the portion of paste for contributing to a user's oral hygiene, the toothbrush assembly thus enabling a user to maintain oral hygiene.

17. The toothbrush assembly of claim 16 wherein the toothbrush assembly comprises a floss assembly, the floss assembly comprising a spool-supporting lid, a floss spool, and a floss cap, the spool-supporting lid comprising a brush-covering inner lid surface, an outer lid surface, a seat-engaging end, a spool-supporting end, a circular transverse lid cross-section, a lid height, and a central longitudinal lid axis, the seat-engaging end being removably seatable upon the brush-engaging end, the brush height being lesser in magnitude than the lid height, the inner lid surface thus for surrounding the paste-dispensing brush, the spool-supporting end comprising a spool-receiving post, the spool-receiving post comprising a post height and a central longitudinal post axis, the spool-receiving post being integrally formed with the outer lid surface, the floss spool comprising a floss length, a spool height, and an outer spool diameter, the floss length being spooled adjacent the post axis, the floss length comprising a floss length end, the post receiving the spooled floss length, the spool-supporting end thus supporting the floss spool, the floss cap comprising a spool-covering inner cap surface, an outer cap surface, a support-engaging end, a top end, floss provision means, a circular transverse cap cross-section, a cap height, and a central longitudinal cap axis, the reservoir axis, the lid axis, the post axis and the cap axis being collinear, the cap cross-section having an inner cap diameter, the support-engaging end being cooperatively associated with the spool-supporting end, the post height and the spool height each being lesser in magnitude than the cap height, the outer spool diameter being lesser in magnitude than the inner cap diameter, the inner cap surface thus for surrounding the floss spool, the floss provision means for enabling a user to utilize a portion of the floss length, the portion of the floss length for contributing to a user's oral hygiene.

18. The toothbrush assembly of claim 17 wherein the top end comprises floss-cutting means, the floss-cutting means enabling a user to selectively cut the floss length.

19. The toothbrush assembly of claim 17 wherein the paste-dispensing brush, the pump member, the plunger, the pump housing, the piston, the paste reservoir, the spool-supporting lid, and the floss cap are constructed from translucent materials, the translucent materials for enabling a user to view internal elements of the toothbrush assembly.

20. The toothbrush assembly of claim 17 wherein the reservoir cross-section has an outer reservoir diameter, the lid cross-section has an outer lid diameter, the cap cross-section has an outer cap diameter, and the lid-receiving seat has an outer seat diameter, the outer reservoir diameter, the outer lid diameter, the outer cap diameter, and the outer seat diameter being substantially equal in magnitude, the toothbrush assembly thus having a substantially uniform outer assembly diameter extending from the seat-engaging end to the bottom end, the outer assembly diameter having a hand-holdable magnitude, the outer assembly diameter thus for enhancing a user's ability to hand hold and manually operate the toothbrush assembly.

21. A paste-dispensing toothbrush assembly for enabling a user to maintain oral hygiene, the toothbrush assembly comprising a paste-dispensing brush, a paste pump assembly, a piston, and a paste reservoir, the paste reservoir comprising an inner reservoir surface, an outer reservoir surface, a bottom end, a housing end, a transverse reservoir cross-section, a reservoir height, and a central longitudinal reservoir axis, the reservoir cross-section having an inner reservoir sectional area, the product of the inner reservoir section area and the reservoir height defining an initial paste-receiving volume, the piston comprising a paste-engaging surface, and an atmospheric surface, the piston being piston received in the paste reservoir, the paste pump assembly comprising a brush-engaging end, a reservoir-engaging end, and paste conduit means, the paste conduit means extending from the reservoir-engaging end to the brush-engaging end for conveying paste from the paste reservoir to the paste-dispensing brush, the reservoir-engaging end being cooperatively associated with the housing end for creating an initial paste pressure intermediate the paste-engaging surface and the reservoir-engaging end, the paste-dispensing brush comprising a pump-engaging end, a brush head, and a brush conduit, the brush conduit for conveying paste, from the brush-engaging end to the brush head, the pump-engaging end being cooperatively associated with the brush-engaging end, the paste reservoir for receiving an initial paste volume, the initial paste pressure being associated with the initial paste volume, the initial paste volume being substantially equal in magnitude to the initial paste-receiving volume, the bottom end comprising atmospheric pressure maintenance means, the paste pump assembly comprising a manually-operable pump member, a pump diaphragm, a plunger, a compression coil, a housing diaphragm, and a pump housing, the pump member comprising a housing-engageable outer pump surface, a plunger-covering inner pump surface, a transverse pump cross-section, and the brush-engaging end, the pump cross-section having a maximum inner pump dimension, the brush-engaging end comprising a lid-receiving seat and a pump paste gateway, the seat-engaging end removably seatable upon the lid-receiving seat, the pump paste gateway being in fluid communication with the brush conduit, the plunger comprising a gateway-engaging end, a paste-pressing end, an inner plunger surface, an outer plunger surface, and a transverse plunger cross-section, the plunger cross-section having a maximum outer plunger dimension, the paste-pressing end comprising a plunger paste inlet, the pump housing comprising a pump-receiving end, an outer housing surface, an inner housing surface, a paste channel, a transverse housing cross-section, and the reservoir-engaging end, the housing cross-section having a maximum inner housing dimension, the paste channel having a channel inlet end, a plunger-receiving end, and a transverse channel cross-section, the channel cross-section having a maximum inner channel dimension and a maximum outer channel dimension, the reservoir-engaging end comprising a housing paste inlet, the compression coil having a pump coil end, a housing coil end, an equilibrium position, and a transverse coil area, the coil area having a maximum coil dimension, the maximum coil dimension being greater in magnitude than the maximum outer channel dimension and lesser in magnitude than the maximum inner pump dimension, the outer pump surface being piston-received adjacent the inner housing surface, the outer plunger surface being piston-received adjacent the inner channel surface, the pump coil end engaging the brush-engaging end, the housing coil end engaging the reservoir-engaging end, the housing diaphragm being cooperatively associated with the housing paste inlet for allowing the forced portion of paste to convey from the paste reservoir to the paste channel, the pump diaphragm being cooperatively associated with the plunger paste inlet adjacent the inner plunger surface for allowing the portion of paste to convey from the paste channel to the pump paste gateway, the pump conduit means thus being defined by the housing paste inlet, the paste channel, the plunger paste inlet, and the pump paste gateway, the pump being piston-compressible, the pump thus compressing the compression coil to a paste displacement position, the compression coil returnable to the equilibrium position, the initial paste pressure tending toward a third paste pressure when the compression coil returns to the equilibrium position, the third paste pressure being lesser in magnitude than atmospheric pressure, the atmospheric pressure maintenance means for exerting piston-moving pressure against the piston to maintain the initial paste pressure as the compression coil returns to the equilibrium position, the pump assembly being operable to increase the initial paste pressure to a second paste pressure, the second paste pressure for forcing a portion of paste from the paste reservoir through the paste conduit means and the brush conduit to the brush head, the portion of paste thus substantially decreasing the second paste pressure to the initial paste pressure when forced from the paste reservoir, the brush head being operable to selectively apply the portion of paste, the portion of paste for selectively contributing to a user's oral hygiene, the toothbrush assembly thus enabling a user to maintain oral hygiene.

22. A paste-dispensing toothbrush assembly for enabling a user to maintain oral hygiene, the toothbrush assembly comprising a paste-dispensing brush, a paste pump assembly, a piston, a paste reservoir, and a floss assembly, the paste reservoir comprising an inner reservoir surface, an outer reservoir surface, a bottom end, a housing end, a transverse reservoir cross-section, a reservoir height, and a central longitudinal reservoir axis, the reservoir cross-section having an inner reservoir sectional area, the product of the inner reservoir sectional area and the reservoir height defining an initial paste-receiving volume, the piston comprising a paste-engaging surface, and an atmospheric surface, the piston being piston-received in the paste reservoir, the paste pump assembly comprising a brush-engaging end, a reservoir-engaging end, and paste conduit means, the paste conduit means extending from the reservoir-engaging end to the brush-engaging end for conveying paste from the paste reservoir to the paste-dispensing brush, the reservoir-engaging end being cooperatively associated with the housing end for creating an initial paste pressure intermediate the paste-engaging surface and the reservoir-engaging end, the paste-dispensing brush comprising a pump-engaging end, a rush head, and a brush conduit, the brush conduit for conveying paste from the brush-engaging end to the brush head, the pump-engaging end being cooperatively associated with the brush-engaging end, the paste reservoir for receiving an initial paste volume, the initial paste pressure being associated with the initial paste volume, the initial paste volume being substantially equal in magnitude to the initial paste-receiving volume, the pump assembly being operable to increase the initial paste pressure to a second paste pressure, the second paste pressure for forcing a portion of paste from the paste reservoir through the paste conduit means and the brush conduit to the brush head, the portion of paste thus substantially decreasing the second paste pressure to the initial paste pressure when forced from the paste reservoir, the floss assembly comprising a spool-supporting lid, a floss spool, and a floss cap, the spool-supporting lid comprising a brush-covering inner lid surface, a seat-engaging end, a spool-supporting end, a transverse lid cross-section, and a central longitudinal lid axis, the seat-engaging end being removably seatable upon the brush-ending end, the inner lid surface for surrounding the paste-dispensing brush, the spool-supporting end comprising a spool-receiving post, the spool-receiving post comprising a central longitudinal post axis, the spool-receiving post being cooperatively associated with the outer lid surface, the floss spool comprising a floss length, a spool height, and an outer spool diameter, the floss length being spooled adjacent the post axis, the floss length comprising a floss length end, the post receiving the spooled floss length, the spool-supporting end thus supporting the floss spool, the floss cap comprising a spool-covering inner cap surface, an outer cap surface, a support-engaging end, a top end, floss provision means, a transverse cap cross-section, and a central longitudinal cap axis, the reservoir axis, the lid axis, the post axis and the cap axis being collinear, the support-engaging end being cooperatively associated with the spool-supporting end, the inner cap surface for surrounding the floss spool, the floss provision means for enabling a user to utilize a floss length portion, the brush head being operable to selectively apply the portion of paste, the portion of paste and the floss length portion for selectively contributing to a user's oral hygiene, the toothbrush assembly thus enabling a user to maintain oral hygiene.

23. The toothbrush assembly of claim 22 wherein the reservoir cross-section, the lid cross-section, the cap cross-section, and the lid-receiving seat each have a substantially uniformly sized end shaped transverse cross-section, the toothbrush assembly thus having a substantially uniform outer assembly surface extending from the seat-engaging end to the bottom end, the outer assembly surface for enhancing a user's ability to hand hold and manually operate the toothbrush assembly.

24. The toothbrush assembly of claim 22 wherein the paste-dispensing brush, the pump member, the plunger, the pump housing, the piston, the paste reservoir, the spool-supporting lid, and the floss cap are constructed from translucent materials for enabling a user to view internal elements of the toothbrush assembly.

* * * * *